US009611634B2

(12) United States Patent
Erlebach

(10) Patent No.: US 9,611,634 B2
(45) Date of Patent: Apr. 4, 2017

(54) ELONGATED SHOWER DRAIN

(71) Applicant: Josef Erlebach, Silverthorne, CO (US)

(72) Inventor: Josef Erlebach, Silverthorne, CO (US)

( * ) Notice: Subject to any disclaimer, the term of this patent is extended or adjusted under 35 U.S.C. 154(b) by 15 days.

(21) Appl. No.: 14/763,033

(22) PCT Filed: Feb. 20, 2014

(86) PCT No.: PCT/US2014/017484

§ 371 (c)(1),
(2) Date: Jul. 23, 2015

(87) PCT Pub. No.: WO2014/186021

PCT Pub. Date: Nov. 20, 2014

(65) Prior Publication Data

US 2016/0130794 A1 May 12, 2016

Related U.S. Application Data

(60) Provisional application No. 61/823,458, filed on May 15, 2013.

(51) Int. Cl.
*A47K 3/00* (2006.01)
*E03F 5/04* (2006.01)

(52) U.S. Cl.
CPC ..... *E03F 5/0408* (2013.01)

(58) Field of Classification Search
CPC ..... E03F 5/0408
USPC ..... 4/613, 287
See application file for complete search history.

(56) References Cited

U.S. PATENT DOCUMENTS

| | | | | |
|---|---|---|---|---|
| 8,239,974 | B2 | 8/2012 | Erlebach | |
| 2010/0162481 | A1* | 7/2010 | Erlebach | E03F 5/04 4/613 |
| 2011/0047695 | A1* | 3/2011 | Niedens | E03F 5/04 4/679 |
| 2011/0088161 | A1 | 4/2011 | Stimpson | |
| 2011/0162137 | A1 | 7/2011 | Kik | |
| 2011/0203979 | A1 | 8/2011 | Schlueter | |
| 2012/0036629 | A1* | 2/2012 | Cook | E03F 5/0407 4/613 |

FOREIGN PATENT DOCUMENTS

KR 20-2010-0011281 11/2010

* cited by examiner

*Primary Examiner* — Huyen Le
(74) *Attorney, Agent, or Firm* — Leyendecker & Lemire, LLC

(57) ABSTRACT

Elongated drain assemblies, systems and their methods of installation suitable for use in tiled shower stalls are described. The drain assembly includes (i) a base unit with locator pins that penetrate a waterproof membrane when installed and are received in locator pin holes in a overlying mounting bracket permitting alignment of fastener holes and bores in the respective bracket and base unit, and (ii) end extenders that can increase the effective length of the trough through attachment to the ends of the base unit thereby allowing drain assemblies of differing lengths to be created for a particular application.

20 Claims, 36 Drawing Sheets

ELONGATED SHOWER DRAIN

CROSS-REFERENCE TO RELATED APPLICATIONS

This application claims the benefit of U.S. Provisional Application No. 61/823,458, filed May 15, 2013, the full disclosure of which is incorporated herein by reference.

FIELD OF THE INVENTION

The present invention pertains to floor drains such as those typically found in residential and commercial showers.

BACKGROUND

Bathrooms and showers stalls are often provided with tiled floors especially in higher end homes. In shower stalls, a drain is typically placed in or near the center of the stall and the floor is sloped slightly towards the center drain to ensure the water runs into the drain as opposed to sitting on the floor or seeping into the structure at the intersection of the floor with the stall walls.

As can be appreciated, tiling a floor that slopes in different directions towards the center of the stall can be difficult and time consuming especially if localized reversed slopes and other slope anomalies are to be avoided. The problem can be especially acute when large-sized tiles (6"×6", 8"×8", 12"×12" and larger) are utilized. Often it is necessary to cut the tiles on a diagonal where two slopes running in different directions intersect.

Elongated drains that are located at one edge of a stall thereby facilitating a floor that slopes primarily in a single direction are known. However, they tend to be best suited for commercial or industrial applications and often require installation by skilled craftsmen to ensure the drain's top surface is effectively even or level with that of the surrounding floor. For instance in many commercial applications like in communal showers, elongated drains are molded into the concrete pans of the expansive floors and are covered with perforated grates. The sides and bottom surfaces of these molded-in drains are then often covered in tiles. Such exacting and time consuming construction make these drains economically unsuitable for use in most residential structures.

Cost-effective prefabricated elongated drains suitable for use in residential structures are just not readily available in the marketplace. Elongated drain assemblies that have been proposed are often not amenable for use by do it yourselfers, who are mechanically astute but lack the experience of tradesmen. Furthermore, prior art assemblies even if amenable for installation by tradesmen are either or both prohibitively expensive and prohibitively expensive to install. These cost considerations ameliorate any potential cost advantages of installing a titled shower with a pan that is sloped in a single direction instead of multiple directions.

DETAILED DESCRIPTION

Figure 1A:
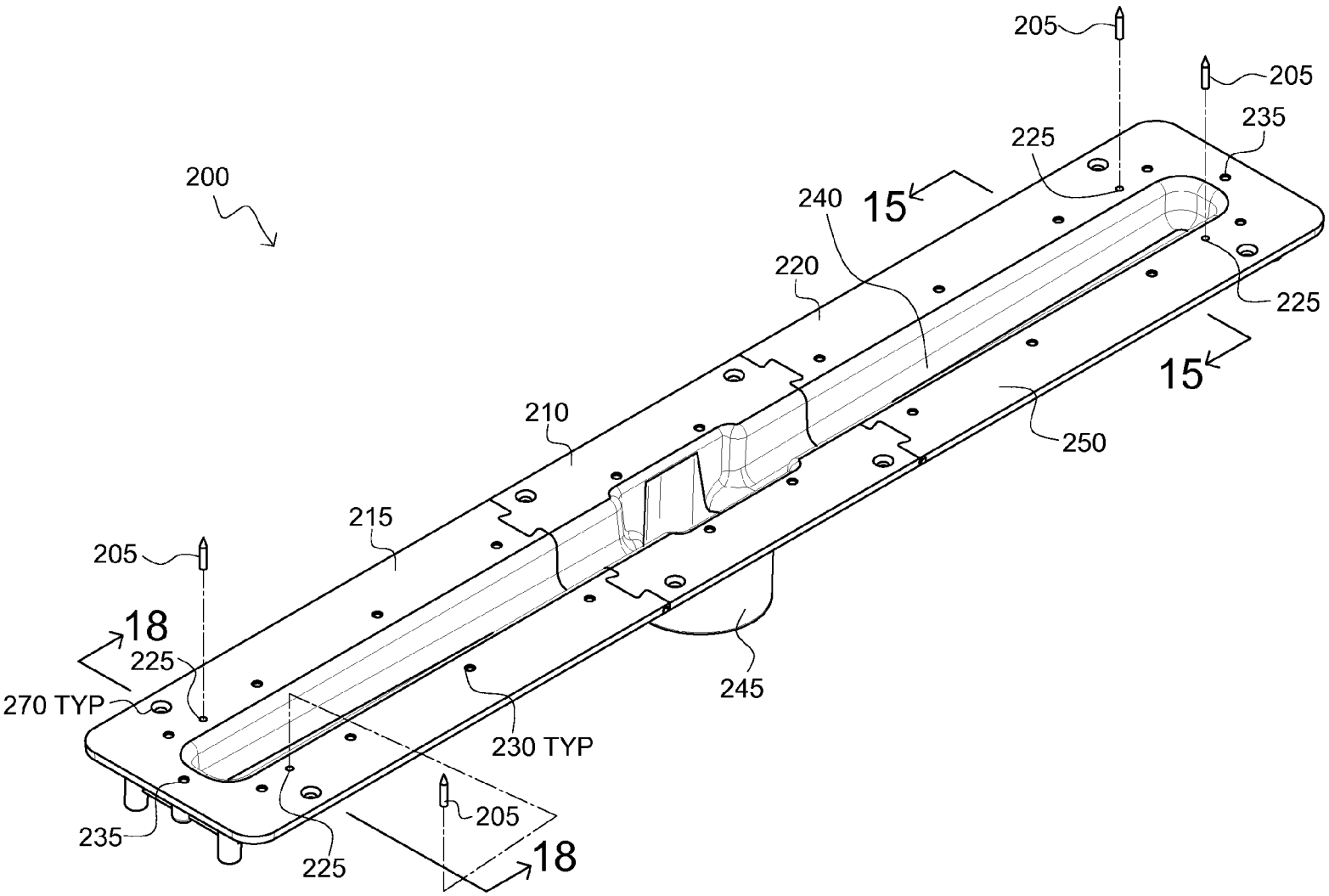
FIG. 1*a* is an isometric top view of an elongated drain body including locating pins according to one embodiment of the present invention.

Embodiments of the present invention comprise elongated drain assemblies suited for use in both commercial and residential construction. Because the elongated drain is typically located at or near one edge of the shower stall proximate a stall wall and/or extends substantially the entire length of the wall, the installation of the associated shower pan is made much simpler. Specifically, compound sloping of the shower floor is not required. The time and cost of creating a pan having a single slope is often reduced over a more complex multi-sloped pan, but also importantly a more aesthetically pleasing shower stall and drain result.

The use of an elongated drain is especially advantageous in shower stalls wherein the floor is finished with larger tiles (6"×6" to 24"×24"). With traditional center drain floors, the use of large tiles is often not possible depending on how the pan is sloped. Even when properly sloped; the tile layer typically has to cut a large number of the tiles on the diagonal to account for the intersection of differently sloped portions of the pan. As can be appreciated the increased complexity of the tiling laying job increases, often substantially, the cost of tiling the shower pan. However, since the pan slopes in substantially a single direction when an elongated drain is used, no special or complex tile work is required; thereby, substantially decreasing the cost of laying the tile.

The size of shower stalls can vary dramatically. However, for maximum effectiveness, an elongated drain should span a significant portion of, and preferably most of, one side of the shower stall. If the drain is shorter than the length of the side, the tile on either side of the drains ends and the underling portion of the shower pan will have to be sloped towards the drain potentially increasing the complexity of the installation somewhat. However, producing drains in many different lengths can require additional expensive tooling that dramatically increases the manufacturer's costs of production and consequently the end price of a finished elongated drain unit.

Embodiments of the drain body (or base unit) are fabricated from PVC or other suitable polymers using multi-piece injections moldings. Left and right side sections (also referred to as wings) are injection molded in a several lengths. The inner ends of the left and right wings are then placed in a center section mold which is injected with the suitable polymeric material. The molten center section material overmolds attachment features, such as lips and dovetail recesses, provided on the inner ends of the left and right wings and fuses the newly created center section with the left and right wings creating a single piece drain base unit. As can be appreciated the selection of left and right wing sections and their respective lengths ultimately determine the length of the resulting drain body.

To further permit additional length adjustment extenders are provided on certain embodiments that (i) interface with the left and right ends of the drain body and an overlying mounting plate, and (ii) direct the flow of water from beyond the end of the trough into the drain's trough. As necessary, the extenders can be trimmed to a length needed for a particular drain installation.

Preferably, a shower pan is constructed that has surface sloped towards a drain inlet. Often the pan is covered with a waterproof membrane to contain shower water above the pan and prevent it from seeping into the underlying floor or building structure. In fabrication, the membrane is placed over the pan and adhesively secured in place. As can be appreciated the membrane that covers the drain must be cut to create an opening coincident with the drain trough. Further, it is desirable to completely seal the membrane around the edges of the membrane opening most typically to a flat surface surrounding the trough on the drain base unit. To affect a good seal, a bead of adhesive is typically placed along the periphery of the trough, and in some embodiments, a substantially rigid mounting plate is placed over the membrane aligning mounting holes to mounting holes in the drain base unit. Screws are placed through the aligned holes and screwed into the drain base unit to compress the membrane against the adhesive and the drain base unit.

Since the membrane is generally opaque, aligning the mounting holes on the mounting plate with those on the underlying drain body can be difficult. Cutting the opening in the membrane that corresponds correctly to the drain trough can also be difficult.

In at least some embodiment of the present invention, pointed locator pins are provided that protrude upwardly from the surface of the drain body. In some variations, the pins are integrally molded into the drain body. In other variations, the pins are separately produced and placed in holes or openings provided for the pins in the base.

Using the foregoing embodiments, the membrane is placed over and against the drain body against a bead of adhesive that has been placed around the trough. The location pins are pressed through the membrane. The mounting plate includes holes that locationally correspond to the pins permitting the installer to accurately place the plate over the drain body. Securing screws can then be fed through the mounting holes on the mounting plate, through the membrane and into the underlying and aligned mounting holes in the drain body. The mounting plate also defines the trough opening, which can be used as a template to cut away the overlying membrane.

Typically, a shower pan is constructed in a high end shower using a dry mix concrete material that is formed over the subfloor to form sloping surfaces towards a drain. Once the pan cures the aforementioned waterproof membrane can be adhesively bonded thereto creating a waterproof surface on which tile can be laid to finish the interior floor of the shower.

In at least some embodiments pertaining to a shower drain system and a methodology of installing an elongated drain in a shower, the shower pan is comprised of rigid pieces of sheet polyurethane foam that have top surfaces with a predetermined slope compared to a horizontal bottom surface. As necessary sheets of pre-sloped foam are cut to fit the shower stall and then adhesively and/or mechanically secured to the underlying subfloor with the top surfacing slopping towards the elongated drain. The waterproof membrane can then be secured to the top surface thereafter. Advantageously, the time required to mix and form the dry mix is eliminated along with the associated labor and its cost. Further, the downtime required to let the dry mix cure to a suitable working strength is also eliminated saving a day or more in shower pan and drain installation.

In yet other variations of the system a drain support frame is provided with upper surfaces that slope on all four sides towards the elongated drain. The shower pan, typically formed from slopped sheets, butts the exterior edges of the frame when the system is installed.

In many embodiments of the elongated drain and associated system, a drain cover is provided. The drain cover is typically comprised stainless steel and rests over the drain opening by way of several supports. The supports are adjustable to permit an installer to install the drain cover with its surface essentially level with the surrounding tiled or otherwise finished shower floor. Embodiments of the cover and associated supports are described in detail in U.S. patent application Ser. No. 12/881,164, which is incorporated herein in its entirety by reference.

Terminology

The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase. The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

As applicable, the terms "about" or "generally" as used herein unless otherwise indicated means a margin of ±20%. Also, as applicable, the term "substantially" as used herein unless otherwise indicated means a margin of ±10%. Concerning angular measurements, "about" or "generally" refers to ±10 degrees and "substantially" refers to ±5.0 degrees unless otherwise indicated. It is to be appreciated that not all uses of the above terms are quantifiable such that the referenced ranges can be applied.

An "elongated drain" as used herein refers to a drain having a trough that is substantially longer than its width. Preferably the length to width ratio of the trough is at least 5; more preferably 10; and most preferably over 20. The trough's bottom is sloped towards a drain pipe connection which can be located on either end of the trough but is typically located generally proximate the length-wise center.

A First Embodiment of an Elongated Drain Assembly

Figure 2A:
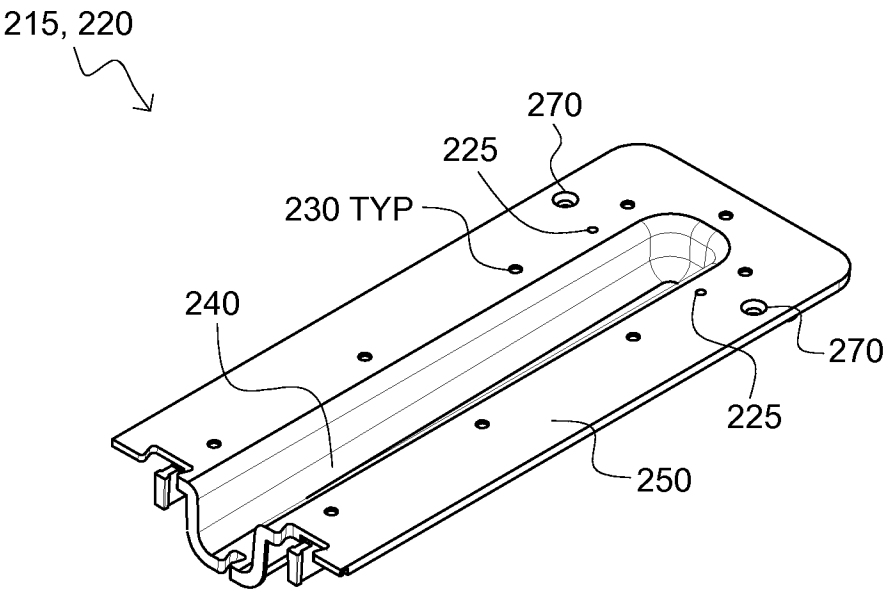
FIG. 2*a* is an isometric top view of a side (or wing) section of the elongated drain body according to one embodiment of the present invention.
Figure 3A:
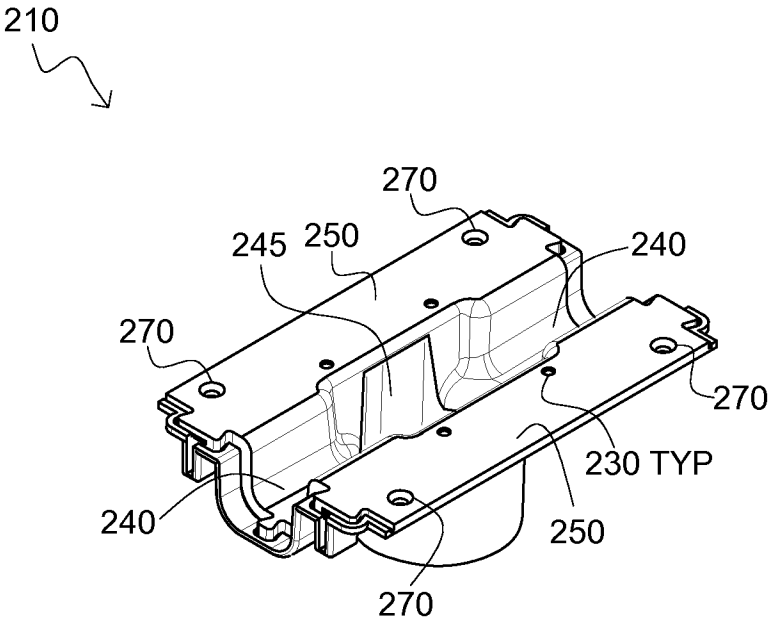
FIG. 3*a* is an isometric top view of a center section of the elongated drain body according to one embodiment of the present invention.
Figure 3B:
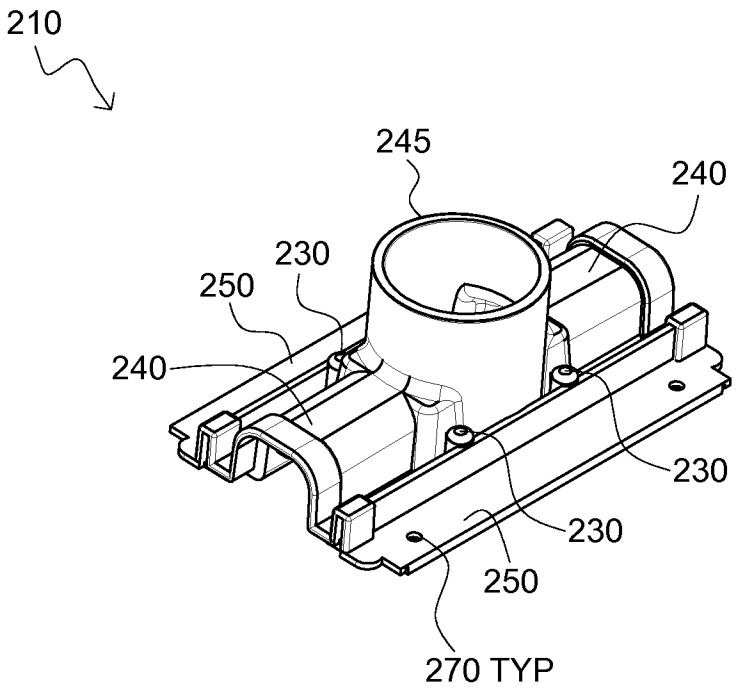
FIG. 3*b* is an isometric bottom view of a center section of the elongated drain body according to one embodiment of the present invention.
Figure 3C:
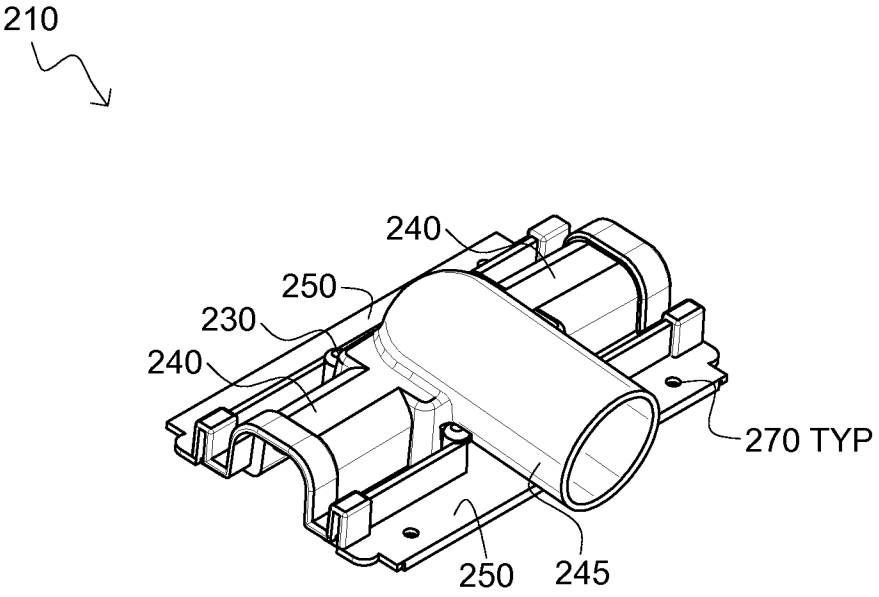
FIG. 3*c* is an isometric bottom view of a side discharge center section of the elongated drain body according to one embodiment of the present invention.
Figure 3E:
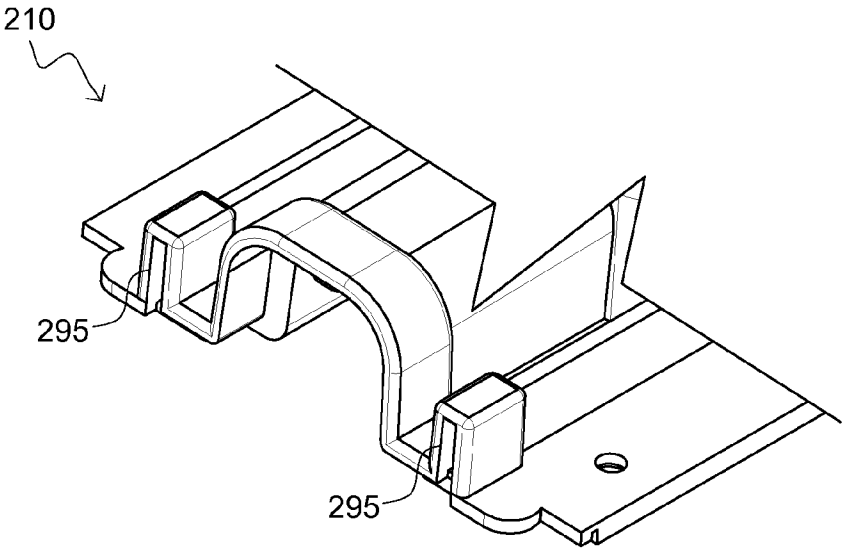
FIG. 3*e* is a partial isometric bottom view of the mating features of a center section of the elongated drain body according to one embodiment of the present invention.
Figure 3D:
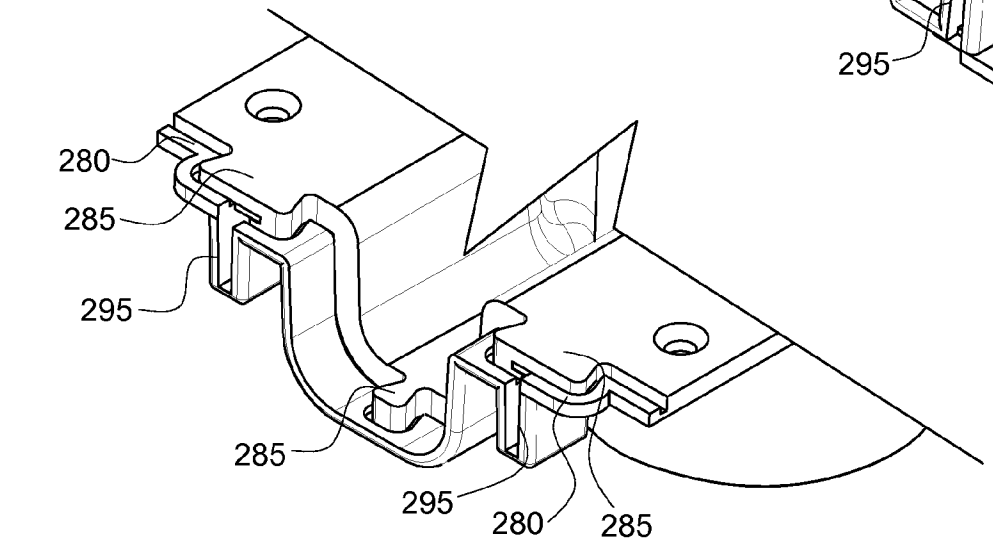
FIG. 3*d* is a partial isometric top view of the mating features of a center section of the elongated drain body according to one embodiment of the present invention.
Figure 4:
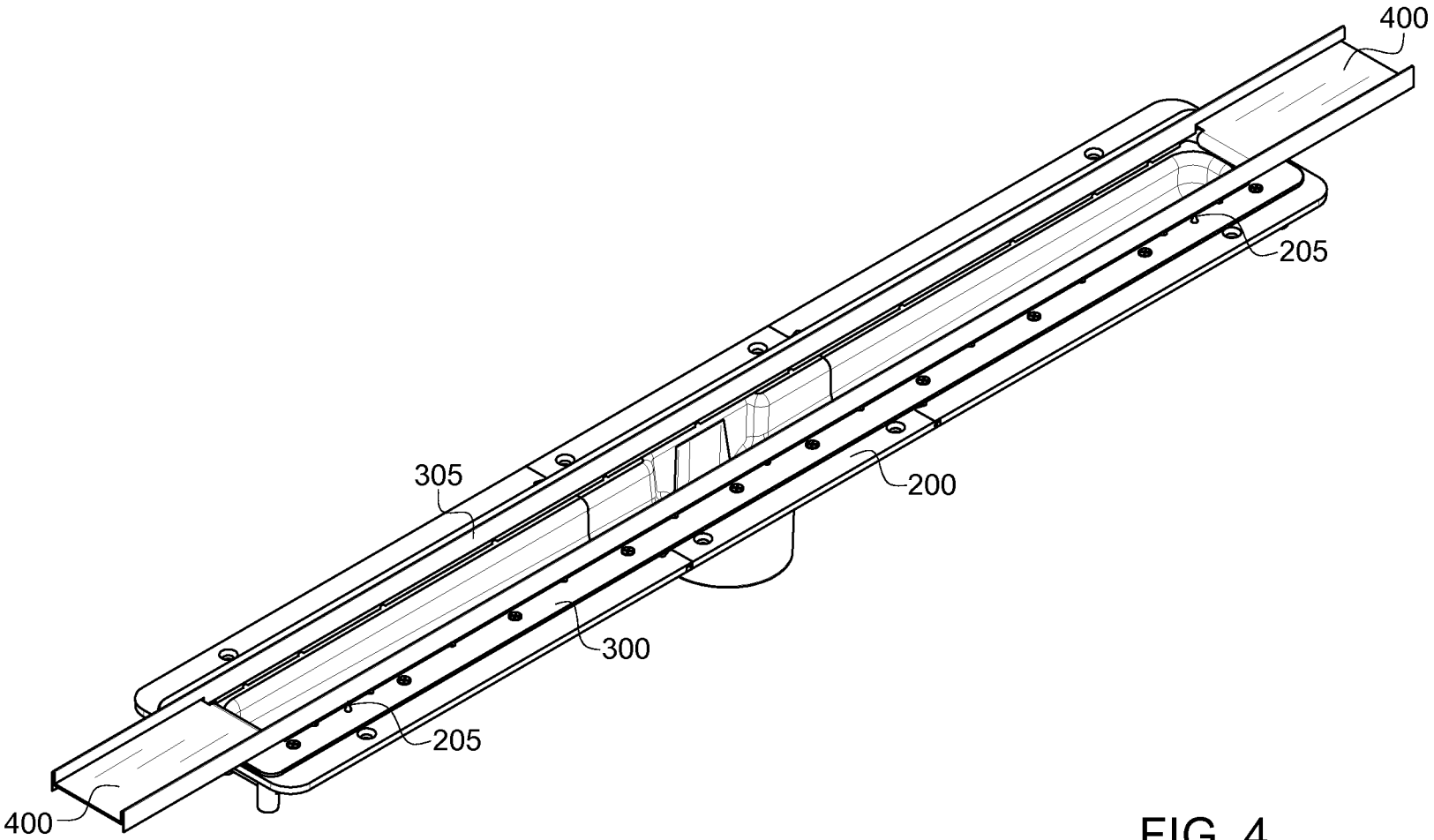
FIG. 4 is an isometric top view of an elongated drain assembly according to one embodiment of the present invention.
Figure 5:
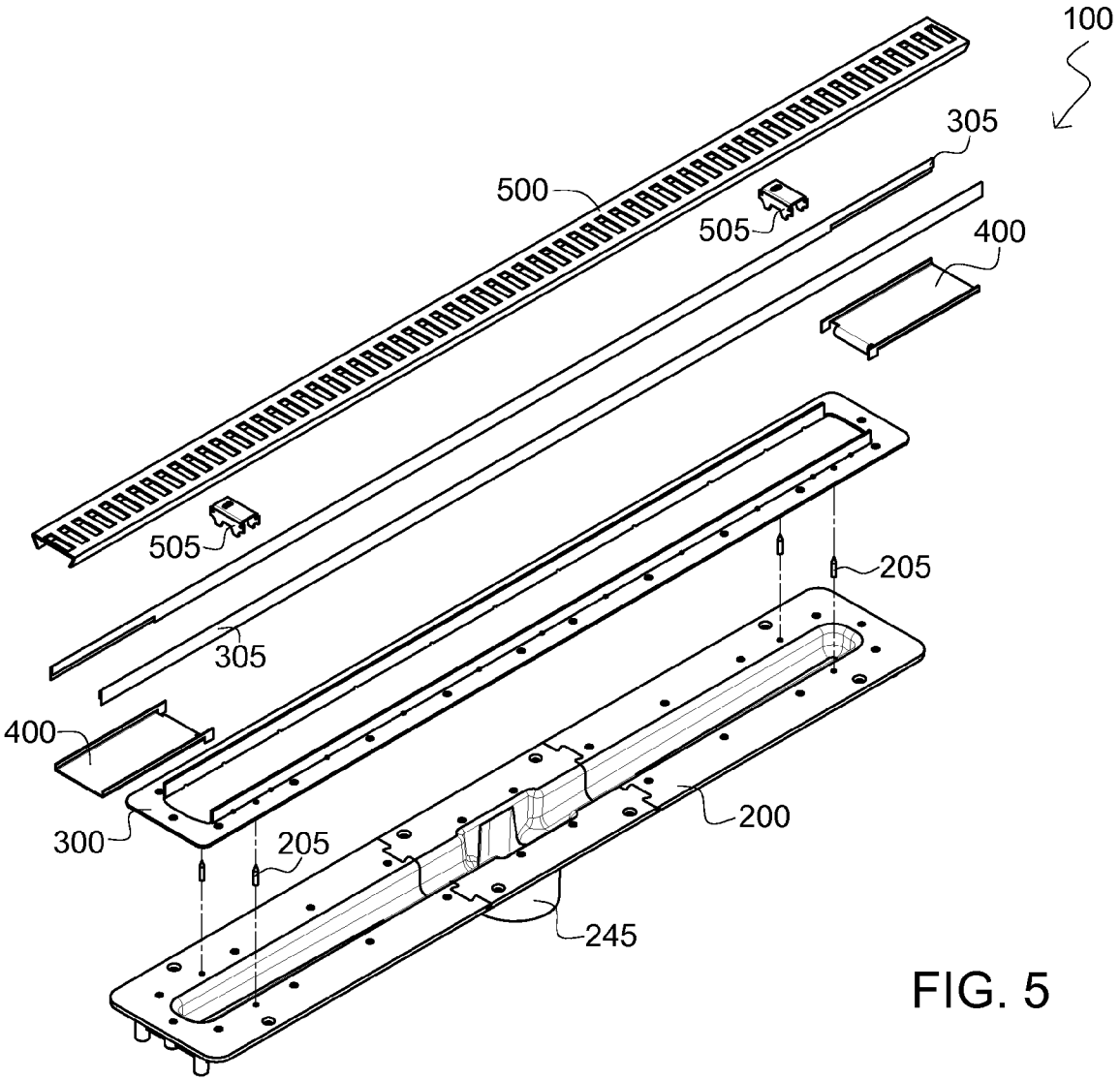
FIG. 5 is an exploded view of the elongated drain assembly according to one embodiment of the present invention.

An embodiment of an elongated drain assembly 100 is illustrated with it various component in FIGS. 4 & 5. Notable individual components are further individually illustrated in FIGS. 1-3 & 6-11. With primary reference to FIG. 5, the typical drain assembly comprises: (i) a drain base unit (or body) 200 including locating pins 205; (ii) a mounting bracket 300 and associated cap rails 305; (iii) optional end extenders 400; adjustable grate spacers 505; and (iv) a grate 500.

Figure 1B:
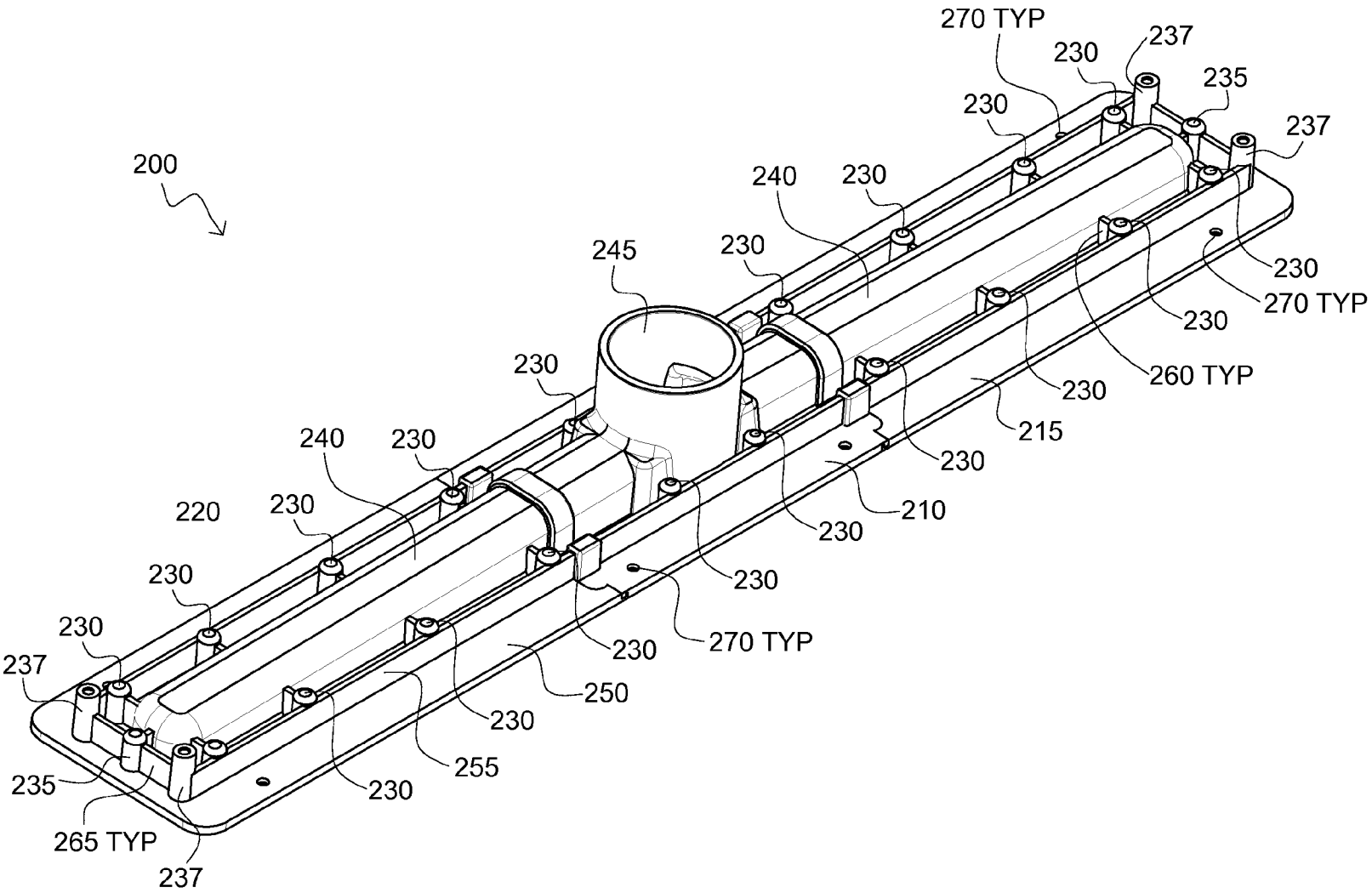
FIG. 1*b* is an isometric bottom view of an elongated drain body including locating pins according to one embodiment of the present invention.
Figure 1C:
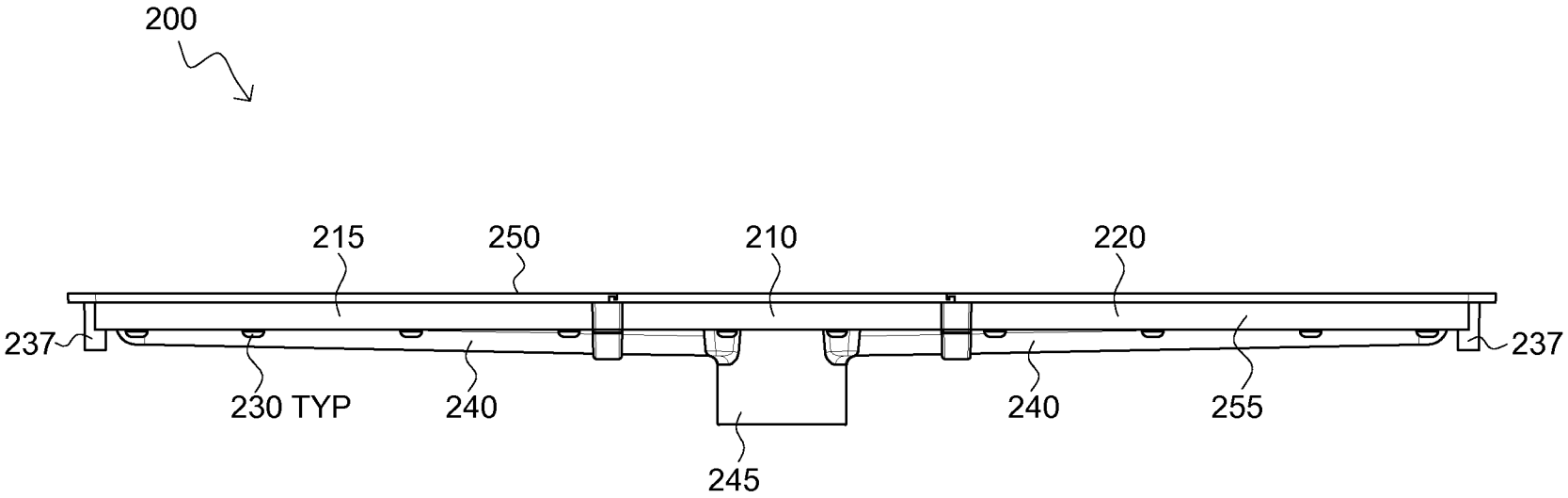
FIG. 1*c* is an isometric side view of an elongated drain body including locating pins according to one embodiment of the present invention.

In at least one embodiment as shown in FIG. 1*a*, 1*b* & 1*c*, the drain base unit 200 is injection molded in three distinct pieces that are joined together during the forming of a center piece 210 which is molded over the proximal ends of left and right sections (or wings) 215 & 220. Locating pins 205 can be molded into the wings or even the center section during the formation of the respective parts, or as shown the pins 205 can be separately fabricated to be received in pin holes 225 formed in the base unit.

The base unit 200 forms a trough 240 with left and right bottom sides that slope gently towards a discharge opening 245. The discharge opening, which is typically configured to coupled with a plumbing drain pipe is typically located proximate the center of the base unit although the location can vary substantially so long as the respective left and right portions are suitably sloped towards the discharge opening. The width of the trough is dictated largely by the diameter of the discharge opening/drain pipe connector which in turn is dictated by the diameter of an associated drain pipe. Typical discharge openings are configured to receive 1.25", 1.5" and 2.0" diameter drain pipes. The discharge opening is typically configured to receive either vertical drain pipe or to receive a more horizontal sloped drain pipe as is shown in FIG. 3*c*.

A flange 250 surrounds the trough 240. In one variation, the flange is about 1.5" wide proximate the elongated sides of the trough and about 1.0" wide proximate the widthwise ends. The thickness of the flange in one embodiment is about 0.160" except for the material comprising various bosses 230, 235 & 237 and reinforcing webs 255, 260 & 265, which vary in depth or thickness from 0.6-1.0 thick. The top surface of the flange is substantially flat and in use a waterproof membrane is received over it.

Figure 2B:
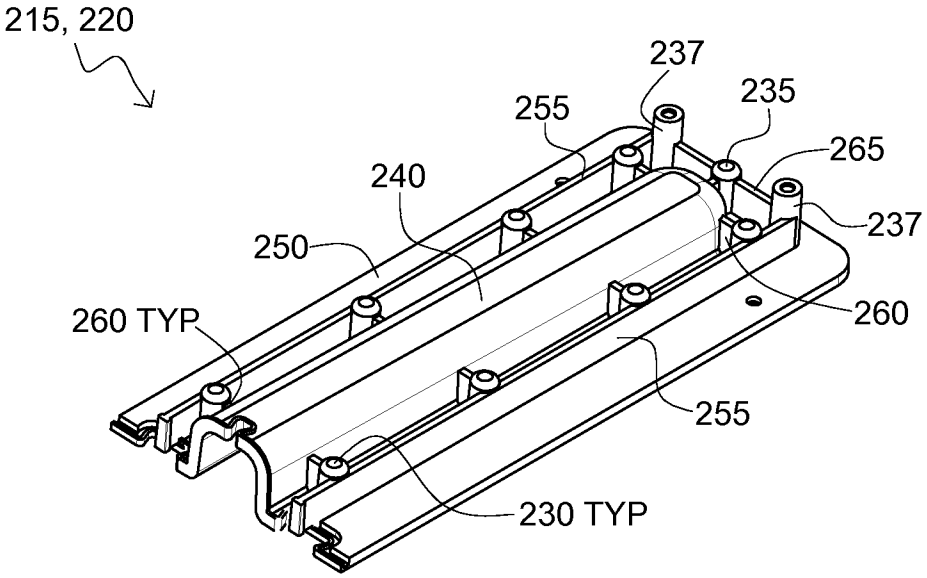
FIG. 2*b* is an isometric bottom view of a side section (or wing) of the elongated drain body according to one embodiment of the present invention.
Figure 2D:
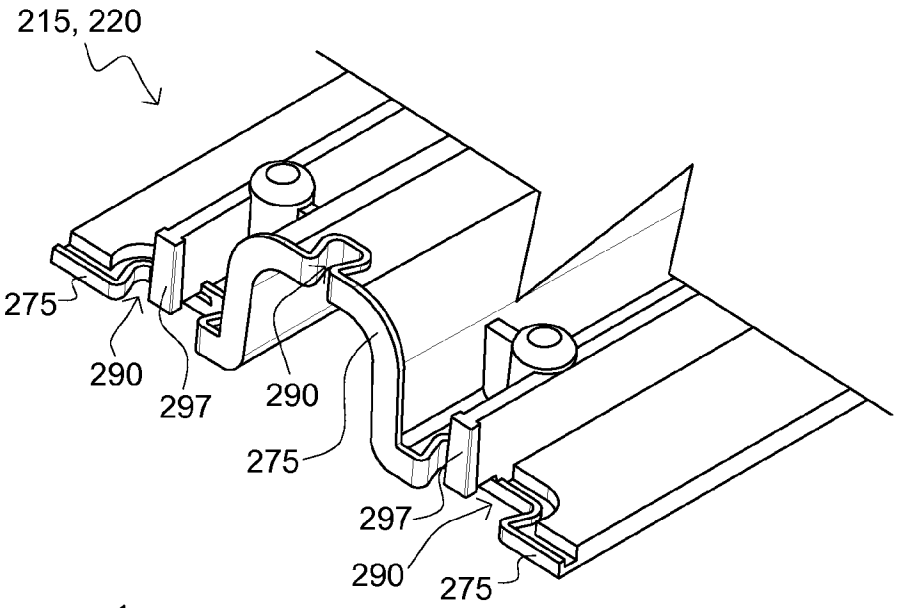
FIG. 2*d* is a partial isometric bottom view of the mating features of a side section (or wing) of the elongated drain body according to one embodiment of the present invention.
Figure 2C:
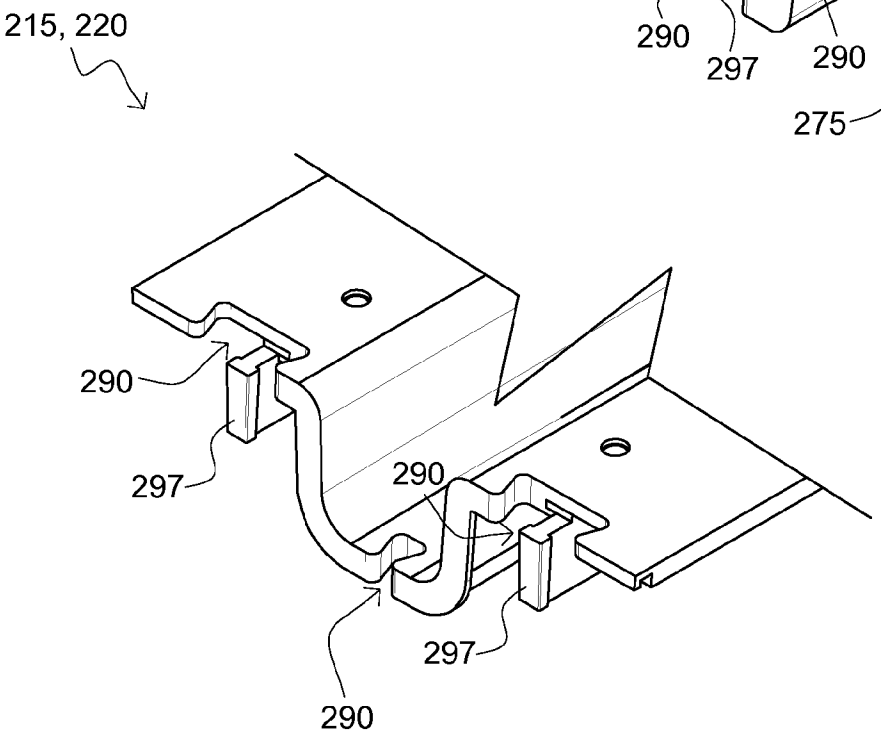
FIG. 2*c* is a partial isometric top view of the mating features of a side section (or wing) of the elongated drain body according to one embodiment of the present invention.

The bosses 230, 235 & 237 are molded into the base unit 200 on the bottom side of the flange 250 as can also be viewed in FIGS. 2*b* & 3*b*. A first set of bosses 230 and end bosses 235 have screw holes formed therein and provide receptacles for threaded fasteners that are used to secure the mounting bracket 300 to the base unit and sandwich a waterproof membrane. The remaining four bosses 237 are located at respective ends of the base unit and extend downwardly a greater distance (or depth) compared to the other bosses 230. These bosses act as legs for the base unit to rest upon the shower subfloor and support the ends of the base unit. The bottoms of the leg bosses 230 also include holes adapted to receive threaded fasteners therein that act as leveling screws and allow the installer to adjust the height of the drain base unit relative to the subfloor when no drain support frame is utilized in installation.

Four pin holes 225 are provided in the flange to receive the locator pins 205. The pins typically interference fit within the holes and are utilized to help an installer align the mounting bracket over the base unit despite the base unit being covered by an opaque waterproof membrane. The pins can be fabricated of any suitable material but are typically polymeric or metallic. In some variations, the locating pins are integrally molded in the base unit.

Six chamfered screw holes 270 are provided through which a screw can be passed and driven into the subfloor to fix the base unit's location in the shower stall depending on the type of installation performed. As can be appreciated the number and location of the various bosses and screw holes and locating pin holes can vary in different embodiments and variations.

As mentioned above, the illustrated embodiment is fabricated from three injection molded sections with the center section 210 (see FIGS. 3*a*, 3*b* & 3*c*) being molded over the left and right end sections 215 & 220 (see FIGS. 2*a* & 2*b*). In other embodiments, the base unit can be molded as a single piece. Typically, the based unit is comprised of PVC or ABS to facilitate effective coupling and bonding with a drain pipe.

Referring to FIGS. 2*c*, 2*d*, 3*d* & 3*e* close ups of the interfaces between the center section 210 and an end section 215 or 220 is provided. A variety of mating features 275, 280, 285, 290, 295 & 297 are provided that help secure the center section to the respective end section when the center section is over-molded around the proximal end of the end section. The features provide interlocking mechanisms that mechanically hold the sections together in addition to any fusing of the surfaces that occurs when the molten polymer in the center section mold meets and surrounds the solidified polymer of the respective end section. In variations, the end and center sections can be separately molded and later joined by sliding the mating features together after applying a suitable ABS or PVC cement to the interfaces of the sections.

In a first mating feature, each end section 215, 220 includes a ridge 275 along the edge of the proximal end on the underside thereof. Each end of the center section 210 also includes a corresponding ridge 280 along its edge on its underside. When a center section is joined to an end section, the two ridges overlap and nest together. The overlapping ridges extend along the entire edges of the respective ends helping to facilitate and ensure a water tight seam.

In a second mating feature, dovetail pins 285 are formed proximate the ends of the center section 210 and corresponding tails 290 are formed at the respective proximal ends of the left and right end sections 215, 220. As shown, larger pin and tail pairs are formed at the edge of the flange bordering the trough 240, and a small pin and tail pair are provided at a bottom of the trough. The interlocking dovetail joints further secure the end sections to the center section.

In a third mating feature, a vertically-extending slot 295 is formed in the ends of the center section 210 proximate the middle of each larger dovetail pin. Corresponding tapered vertical keys 297 are formed in the respective proximal ends of the end sections that are received in the slots to further secure the sections together.

The three part base unit 200 construction permits a greater number of elongated drain configurations to be produced more economically by reducing the overall investment in expensive injection molding tooling. For example to produce one piece elongated drain base units in 24", 30", 36", 42", 48", 54, 60" & 66" lengths in both bottom and side discharge drain pipe configurations for each of three drain pipe diameters, a total of at least 48 different complex injection molds are required. Additionally, injection molding the longer lengths in one piece can be technically difficult substantially increasing the cost of the molds and fabrication. Assuming that the discharge opening is to be located at the center of any base unit, only fourteen molds would be required to make the same number of different base units when fabricated as three pieces: six center section molds; and eight wing section molds. As can be appreciated, it may be possible to reduce the number of molds even more if drain base units with off center discharge openings are acceptable. For instance, the molds for a 36" base unit could comprise an 8" center section 210, an 8" wing section 215 and a 20" wing section 220. Alternatively, using the fourteen molds required to produce the variations listed above with centered discharge openings, additional special order sizes could be produced with off center discharge openings. For instance, a special order 39" drain base unit could be produced using an 8" center section 210 and 14" and 17" wing sections 215 & 220. It is appreciated that the lengths and configurations presented herein are done so only by way of example and that in actual production the lengths of the base units as well as the lengths of the discharge and wing sections can vary as desired by a manufacturer.

Figure 6A:
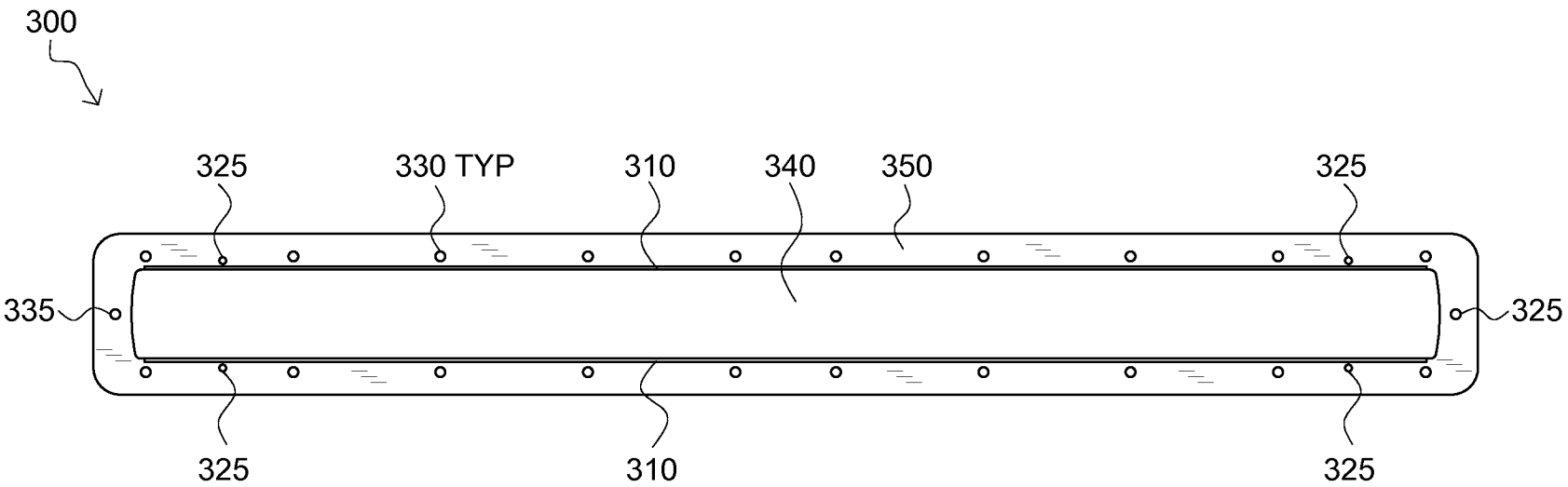
FIG. 6*a* is an isometric top view of a mounting plate of the elongated drain assembly according to one embodiment of the present invention.
Figure 6B:
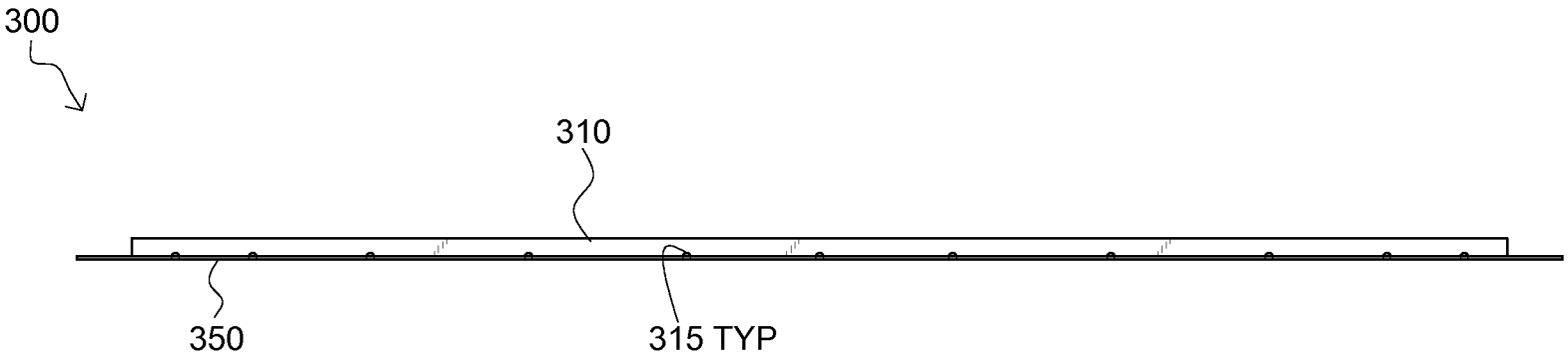
FIG. 6*b* is an isometric side view of the mounting plate of the elongated drain assembly according to one embodiment of the present invention.

The mounting plate 300 is illustrated in FIGS. 6*a* & 6*b* and is typically fabricated from stainless steel plate. In at least one variation 0.065" thick plate is used. A center section of the plate is removed having a length similar to that of a corresponding base unit's trough 240 and forming a trough opening 340. The lengthwise edges of the bracket along the lengthwise edges of the trough opening are bent upwardly to form orthogonal walls 310 relative to a remaining flange section 350 of the bracket. Mounting holes 330 are formed in the bracket to accommodate the mounting plate fasteners. Additional holes 325 are provided to receive the locating pins that are either received in or emanate from the base unit 200.

As can be seen in FIG. 6*b*, a plurality of weep holes 315 are provided at the right angle intersection of the orthogonal walls 310 and the flange portion 350 of the mounting plate. These openings permit the small amount of water that may over time seep through the shower grout lines and flow between the bottom side of the tile and cement toward the drain to drain into the trough 240 thereby preventing the region of the shower floor surrounding the drain assembly from possibly becoming waterlogged.

When aligned with the corresponding holes in the base unit and the locating pins, the trough opening 340 surrounds and corresponds to the trough 240 of the base unit 200. The mounting plate flange section 350 sits above the flange portions of the base unit with a waterproof membrane being typically sandwiched therebetween. The primary functions of the mounting plate all of which are described and discussed in greater detail below include (i) providing a defining edge against which the tile or other flooring abuts along the lengthwise-extending orthogonal walls 310, (ii) sandwiching and sealing the edges of the waterproof membrane around the trough against the base unit flanges to prevent water seepage into the subfloor, and (iii) providing a connection point for end extenders 400 in some variations.

Figure 7A:
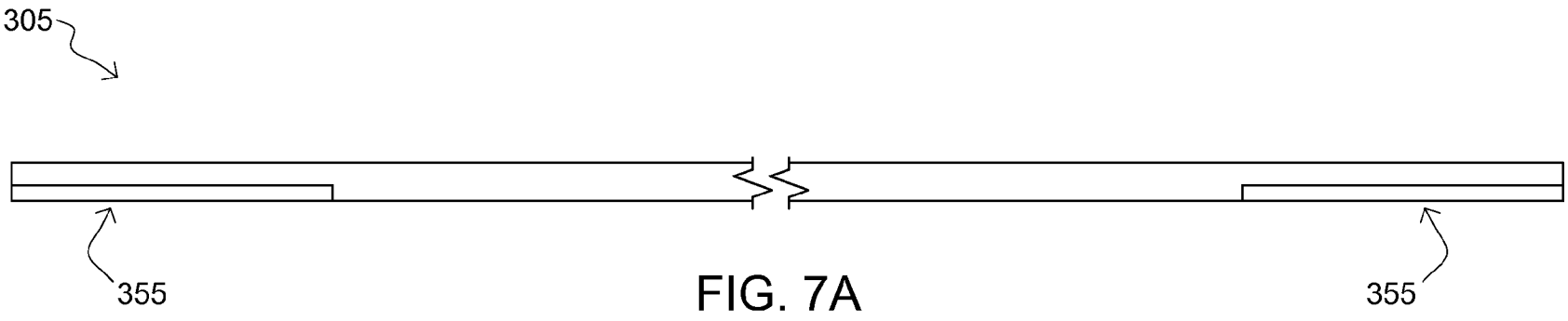
FIG. 7*a* is an isometric view of a cap rail of the elongated drain assembly according to one embodiment of the present invention.
Figure 7B:
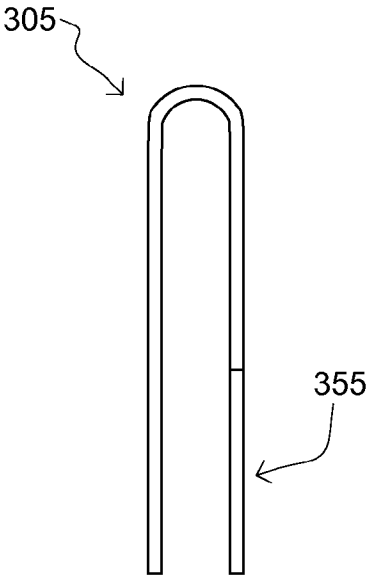
FIG. 7*b* is a cross sectional end view of the cap rail of the elongated drain assembly according to one embodiment of the present invention.

The system also includes cap rails 305, which are shown in FIGS. 7*a* & 7*b*. The cap rails are typically comprised of stainless steel sheet that has been formed into a u-shape with the width of the opening defined between the legs thereof being slightly less than the thickness of the mounting plate's orthogonal walls 310. The cap rail is received over the orthogonal walls and covers the top edge thereof with a smooth and rounded surface. Additionally, the rail can be moved upwardly about 0.10-0.20" to effectively extend the height of the corresponding orthogonal wall (in combination with the rail) to accommodate thicker shower floor tiles.

In some variations, the cap rail 305 is longer in length than the orthogonal walls to interface with the edges of the end extenders 400 and to effectively provide a sidewall thereto against which the adjacent shower floor tiles can abut. As shown in the FIGS. 7*a* & 7*b*, a portion of the inside leg of the cap rail is cut away to avoid interference with the bottom side of the extender, which is located vertically higher than the interface between the orthogonal wall 310 and the flange of the base unit.

Figure 8C:
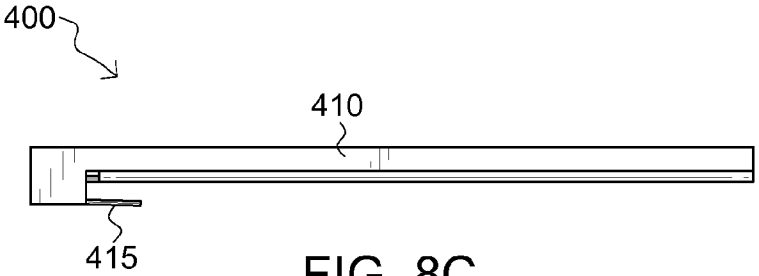
FIG. 8*c* is an isometric bottom view of the end extender piece according to one embodiment of the present invention.
Figure 8A:
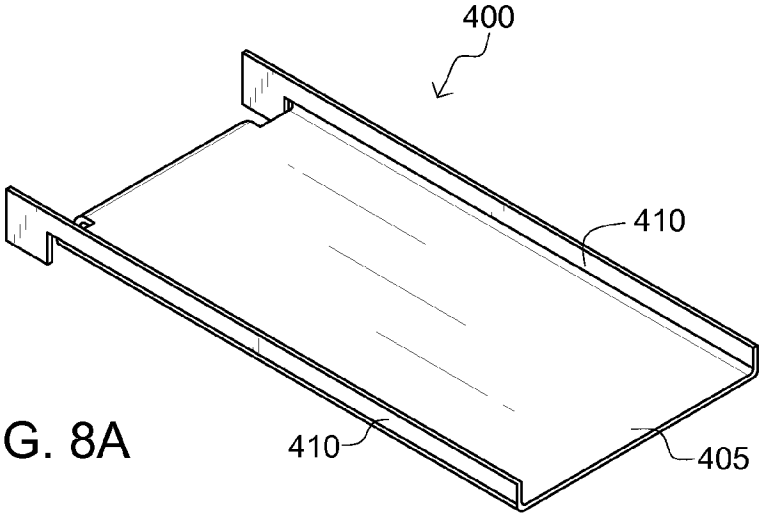
FIG. 8*a* is an isometric top view of an end extender piece according to one embodiment of the present invention.
Figure 8B:
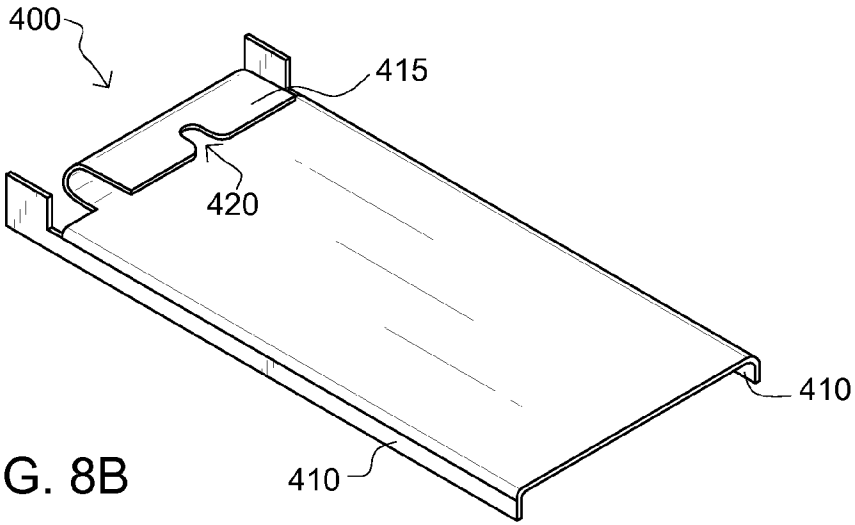
FIG. 8*b* is an isometric bottom view of the end extender piece according to one embodiment of the present invention.

The end extenders 400 are illustrated in FIGS. 8*a*, 8*b* & 8*c*. They are typically utilized in installations where the base unit 200 itself does not span the entire width of a shower stall and the architect or other designer desires the drain to span the entire width for any number of reasons including aesthetics and to eliminate the need to slope a portion of the floor located adjacent the lateral ends of the drain towards the trough.

The extender 400 is typically comprised of stainless steel sheet that has been bent or otherwise formed into a desired configuration. To form a channel that when installed slopes towards the trough 240 of the base unit 200. The extender includes a bottom side 405 that is bounded on its lengthwise edges by orthogonal sidewalls 410. At a proximal lateral edge, a lip of sheet material extending from the bottom side is bent back upon itself forming a u-shaped portion with the back surface of the bottom side. The bottom leg 415 of the u-shaped portion rests on the flange section 350 of the mounting plate 300. The bottom leg is angled slightly off parallel with the bottom side, such that the bottom side channel slopes towards the trough. The bottom side leg also includes a slot 420 formed therein in which the shaft of a corresponding fastener just below the fastener's head can be received to hold the extender in place.

Figure 9:
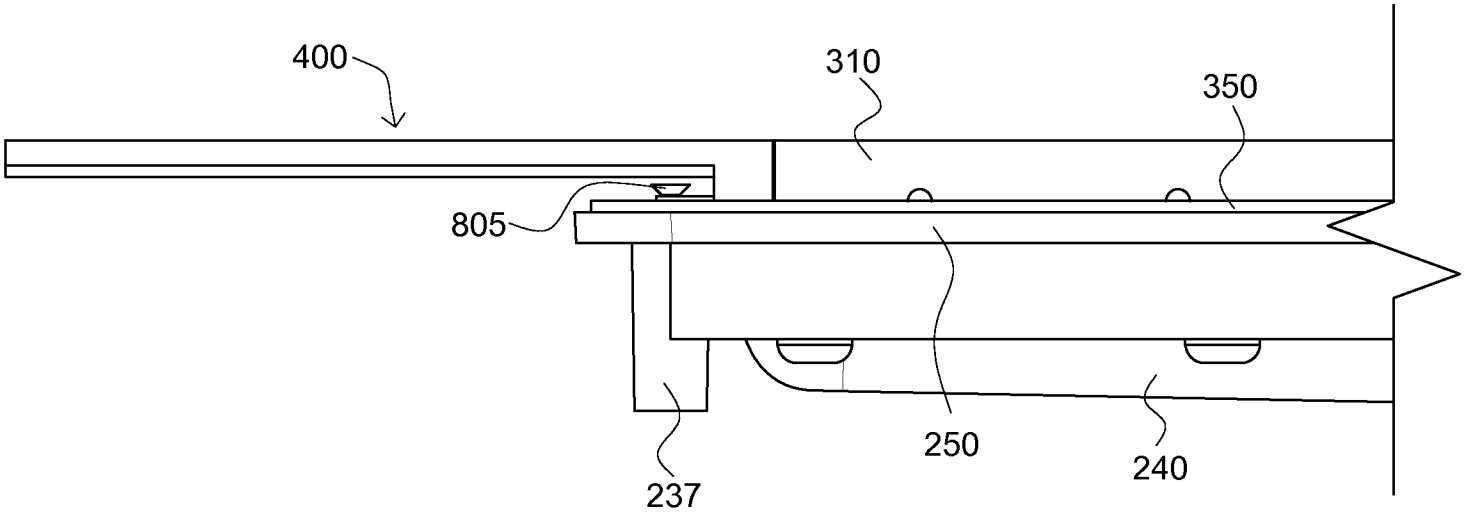
FIG. 9 is a partial side view of the assembly illustrating the attachment of an end extender according to one embodiment of the present invention.

With reference to FIG. 9, the corresponding fastener 805 is utilized to secure the extender 400 to the mounting plate 300 proximate the lateral ends of the base unit 200 and the mounting plate. During installation of the elongated drain system, the applicable fastener is at least partially tightened to secure the mounting plate to the base unit usually sandwiching a waterproof membrane therebetween. The extender is then installed by sliding the slot 420 of the extender around the shaft of the fastener between the fastener's head and the top surface of the mounting plate's flange portion 350. The extender is then rotated as necessary to align its channel with that of the through and but the extender sidewalls 410 against the mounting plate's orthogonal walls 310. As described above, the cap rails 305 can be placed over the sidewalls of the extenders after installation of the drain system.

As can be appreciated, the length of the extenders 400 can be cut as necessary to a desired length. Correspondingly, the length of the cap rails 305 can be cut to match the overall length of the drain. Alternatively, both extenders and cap rails can be manufactured in a variety of lengths. Once installed and once the tile floor is installed around the drain including cement and grout, the extenders and cap rails become fixed in place with little risk that the cap rails (especially if raised upwardly on the orthogonal walls 310) and the extenders will move from their desired adjusted positions.

Figure 10A:
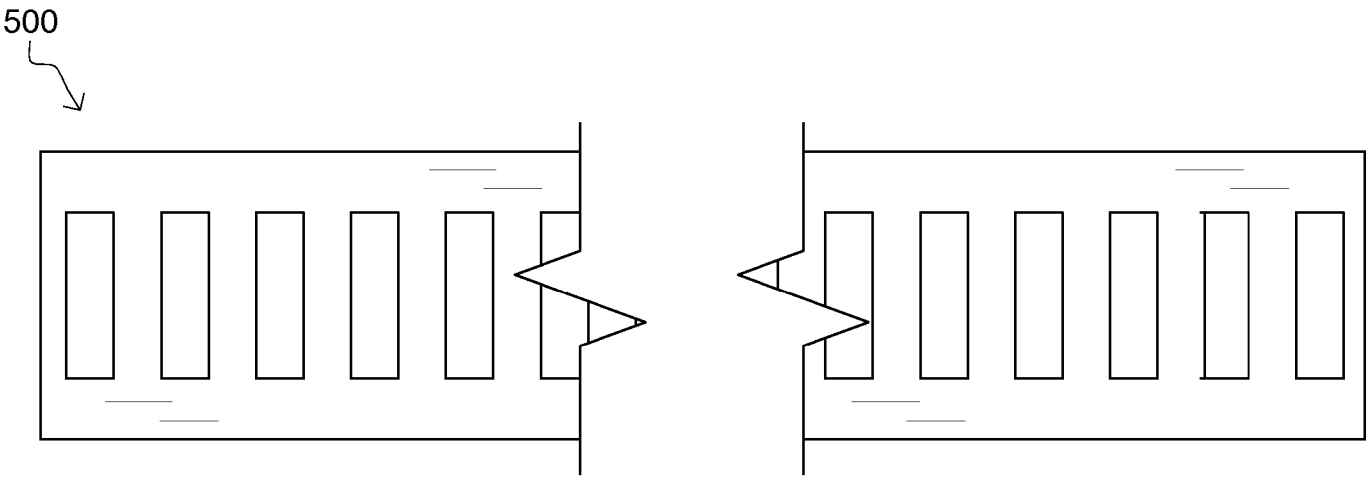
FIG. 10*a* is a top view of a drain grate according to one embodiment of the present invention.
Figure 10B:
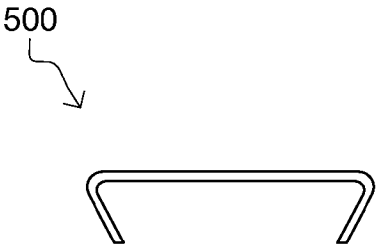
FIG. 10*b* is an end view of the drain grate according to one embodiment of the present invention.
Figure 11:
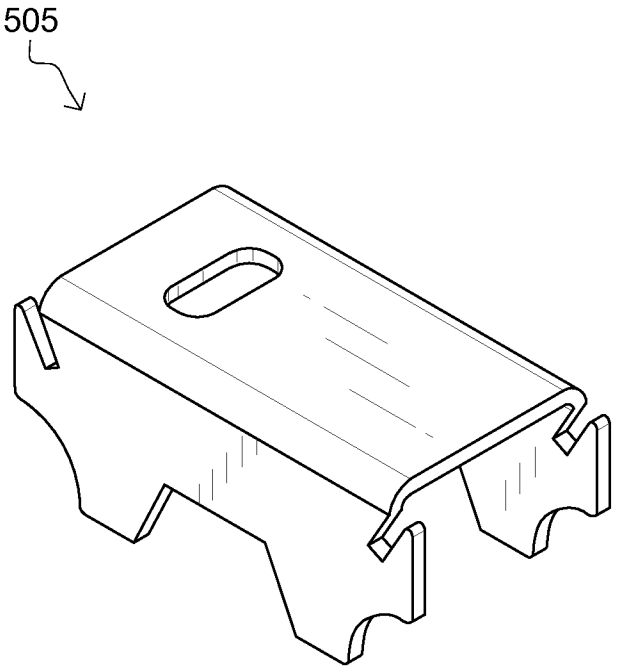
FIG. 11 is an isometric view of a grate spacer according to one embodiment of the present invention.

The elongated drain system also includes a grate 500 and a plurality of associated grate spacers 505 that support the grate on the base unit 200. A typical grate is illustrated in FIGS. 10*a* & 10*b* and one type of spacer is illustrated in FIG. 11. The features and operation of the grate and spacers including height adjustable spacers are described in U.S. patent application Ser. No. 12/881,164, which has been incorporated in its entirety herein.

Several different designs of fasteners are utilized in the assembly of the elongated drain system. As a general consideration, the fasteners comprise stainless steel screws. The screws are typically of the wood screw type that self tap in either or both (i) the plastic bosses provided to for use in securing the mounting plate to the base unit, and (ii) the underlying wood subfloor to secure the drain unit thereto. As can be appreciated the screws used to mount the system to the floor are longer than those used to secure the mounting plate. As can be appreciated, in variations the bosses can be formed with threaded inserts molded therein and in these variations, machine type screws can be utilized instead of wood screws. Further, in variations the screws may be comprised of materials other than stainless steel.

An Embodiment of an Elongated Drain System incorporating a Drain Support

Figure 12A:
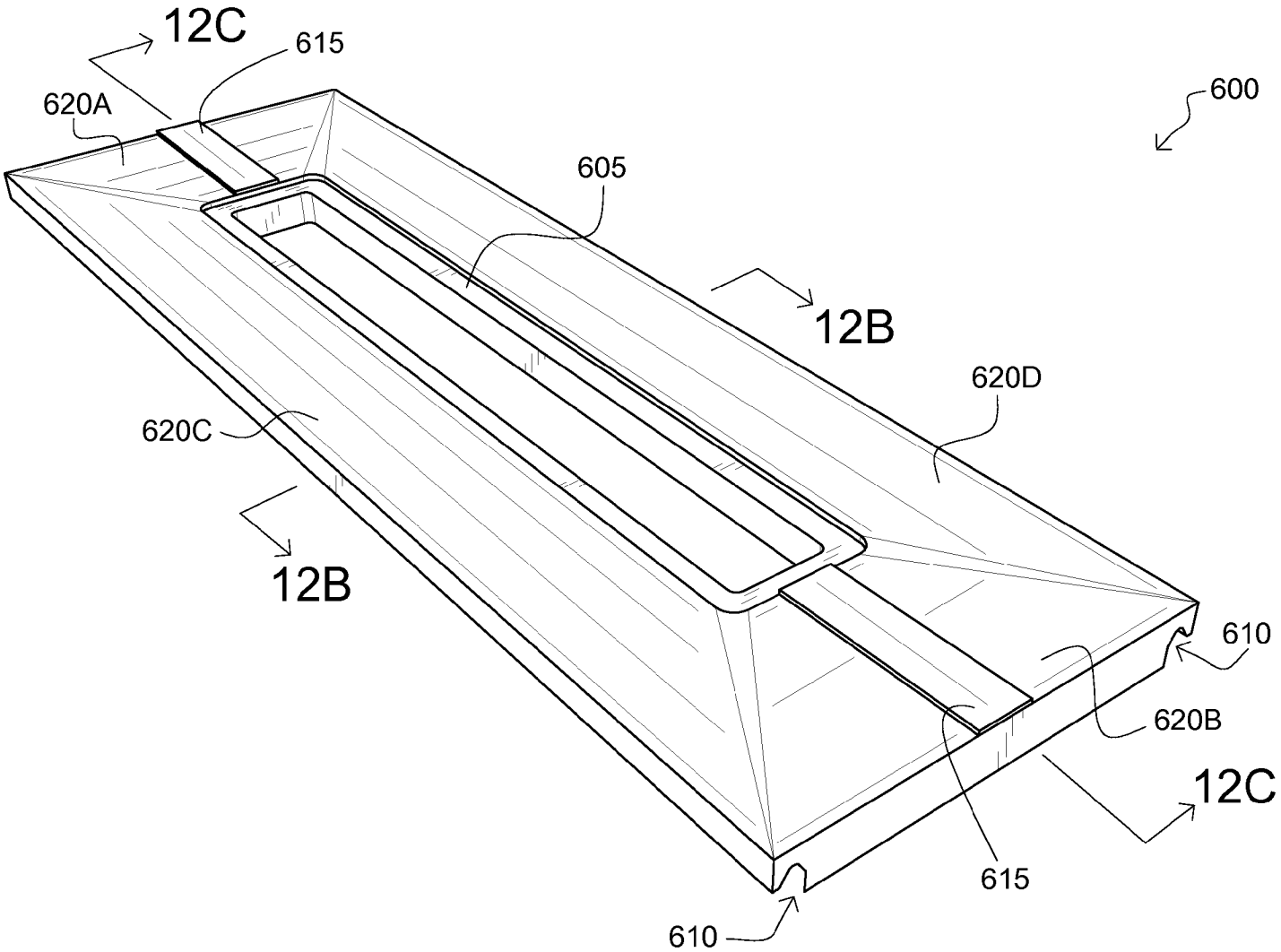
FIG. 12*a* is an isometric top view of a drain support member according to one embodiment of the present invention.
Figure 12B:
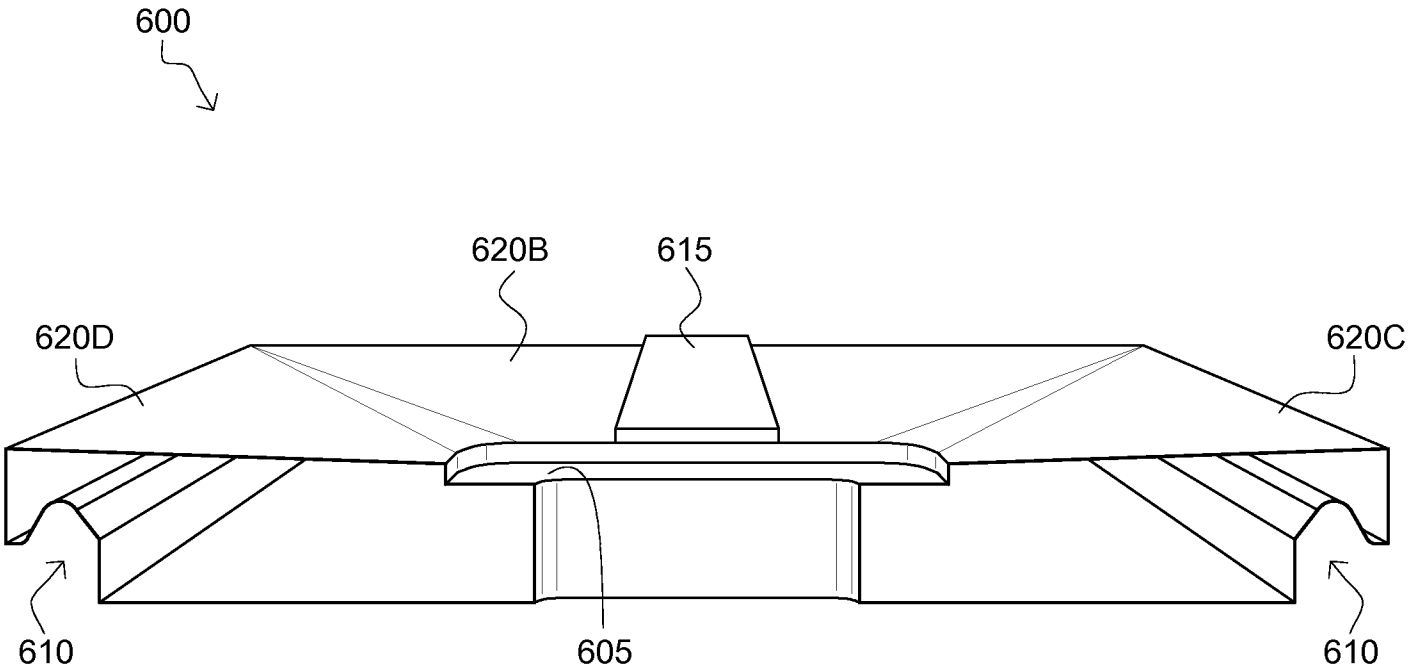
FIG. 12*b* is a cross sectional view of a drain support member taken along line 12*b*-12*b* in FIG. 12*a* according to one embodiment of the present invention.
Figure 12C:
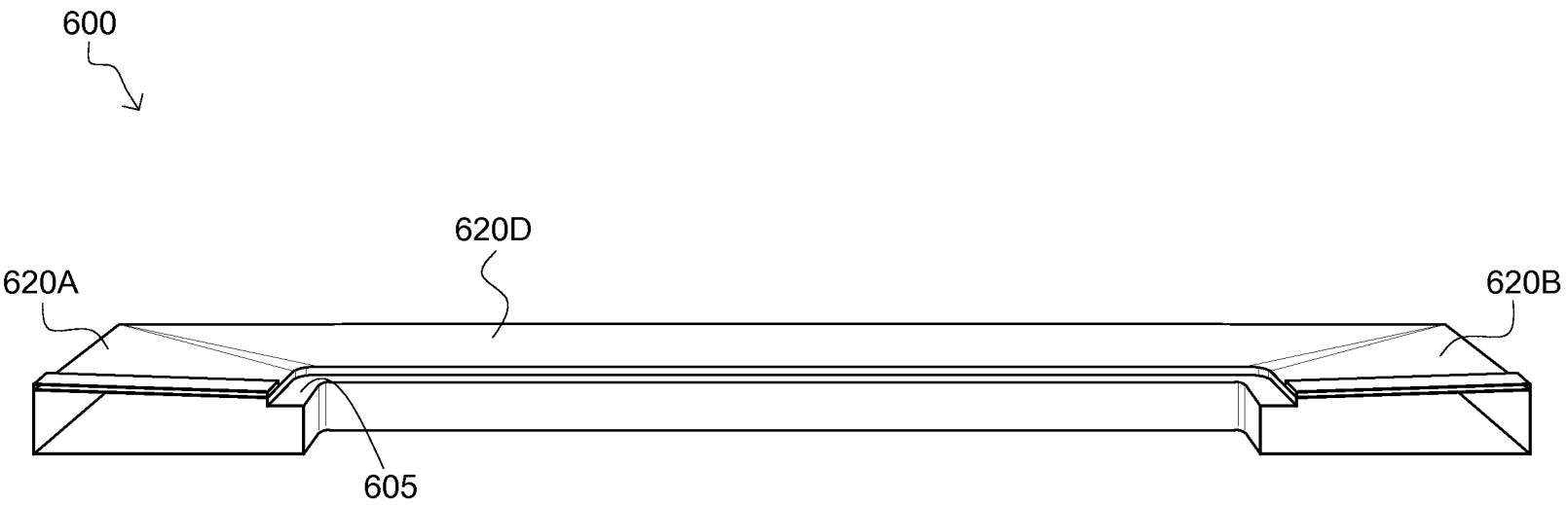
FIG. 12*c* is a cross sectional view of a drain support member taken along line 12*c*-12*c* in FIG. 12*a* according to one embodiment of the present invention.

At least one embodiment of the system described above incorporates a drain support 600 as illustrated in FIGS. 12*a*, 12*b* & 12*c*. The drain support is typically molded of a suitable plastic, such as polyurethane, ABS or PVC. In at least one variation, the drain support is fabricated from polyurethane using a reaction molding process that does not require the expensive tooling as is necessary to injection mold the support out of PVC or ABS. The support can be molded in multiple pieces that are later joined together. It comprises a recess 605 that cradles the drain base unit 200 within a provided recess. The surfaces surrounding the four sides 620*a*, 620*b*, 620*c* & 620*d* of the recess slope gently toward the recess. Practically, the support is utilized in showers wherein the width of the shower stall is greater than the width of the elongated drain base unit 200 being utilized and the use of end extenders 400 is required.

As also shown in FIGS. 12*a* & 12*b*, in one variation of the drain support 600, a lipped longitudinally extending downwardly facing recess 610 is provided along both longitudinal edges of the support. These recesses are configured to interface with a mating edge of certain variations of slopped underlayment panels 625 as is described in greater detail below. In other variations, no longitudinal recesses are provided along the edges of the drain support.

The four slopped surfaces 620*a*, 620*b*, 620*c* & 620*d* define the shape of tiles received over them to ensure shower water is properly directed into the drain without the need for undue guesswork by an installer as to not only the shape of the tiles surrounding the drain but also the manner in which that are laid to ensure a proper slope.

As is evident in the FIG. 12*a*, at the center of the laterally extending sides 620*a* & 620*b* an elevated ridge 615 is provided that has the same slope as the sides on which it rests. This slope also substantially matches the slope of an end extender 400 such that the end extender rests on and is supported by the ridge. As can be appreciated the tiles cut for and laid on the lateral ends abut the edge of the respective end extenders.

An Embodiment of an Elongated Drain System incorporating Sloped Drain Panels

Figure 13:
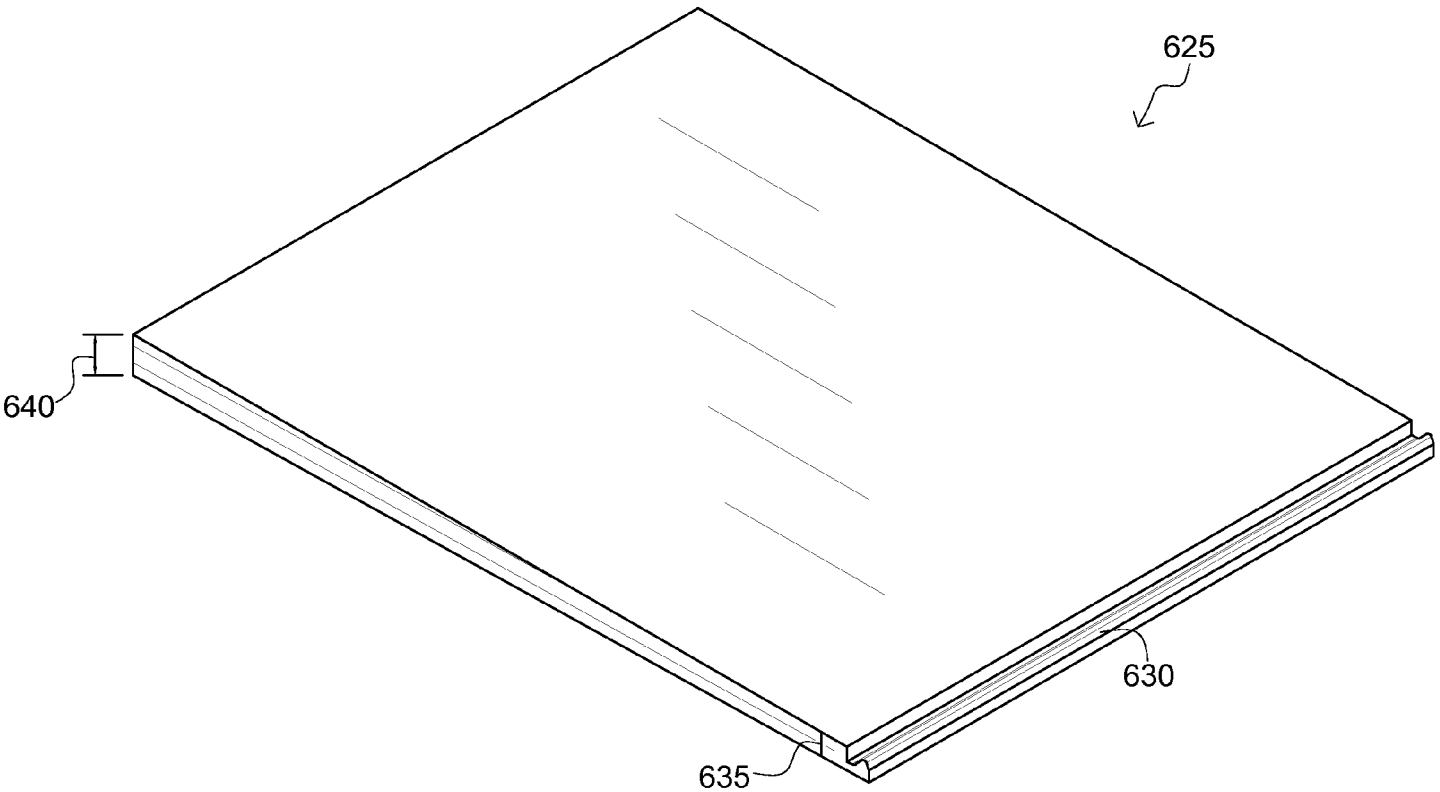
FIG. 13 is an isometric top view of a sloped panel utilized in the fabrication of a shower pan according to one embodiment of the present invention.

Some embodiments of the elongated drain system are also used in conjunction with sloped drain panels 625 that are used to form a shower pan having the proper slope towards the elongated drain inlet. FIG. 13 is an illustration of a typical panel, which comprises a sheet of polymeric material, such as reaction-formed rigid polyurethane foam, that slopes from one end towards another. As illustrated the panel is about three feet two inches wide and four feet long. It generally and uniformly slopes from about 2.38" at its thickest 640 to about 1.38" thick 635 proximate an edge having an upwardly facing lip 635. The lip is configured for mating receipt with the downwardly facing lip 610 and mechanically couple the panel to a drain support 600.

The sizes and thicknesses of the panels can vary as necessary to properly cover shower stall subfloors of differing overall sizes. As can be appreciated, however, the cost of the panels exceeds the cost of dry mix, such that for large area shower stalls the use of a dry mix shower pan is often more economical than using the sloped boards. In smaller shower stalls wherein the distance from the drain to the opposing wall of the stall is no greater than four feet, money saved in reduced time and labor using the sloped boards more than offsets the increased cost of the boards.

Numerous other variations are anticipated in drain panels 625. In one variation the panel comprises a honeycomb material that can be fully or partially filled with adhesive or dry mix material. In other variations, all the edges of the panel are square and do not have an upwardly or even downwardly facing lip designed to interface with the drain support. The types of material from which the panels are fabricated can also vary. While polymeric sheets are contemplated the panels may also comprise cementitious material or even wood.

Methods of Installing an Elongated Drain Assembly/System According to Embodiments of the Present Invention First Method of Installing the First Embodiment Elongated Drain Assembly Numerous methods of installing the elongated drain assembly along with a shower pan and suitable floor are contemplated. The three methods anticipated to be the most common are described herein. The first method utilizes the drain assembly in conjunction with a drain support frame and sloped panels and does not typically require the use of dry mix concrete in the fabrication of the shower pan. The second method also uses the drain support frame but the shower pan is formed using a dry mix concrete up to and against the outer edges of the support member. The third method eschews the use of the drain support frame and utilizes a dry mix to completely form the shower pan.

Figure 14:
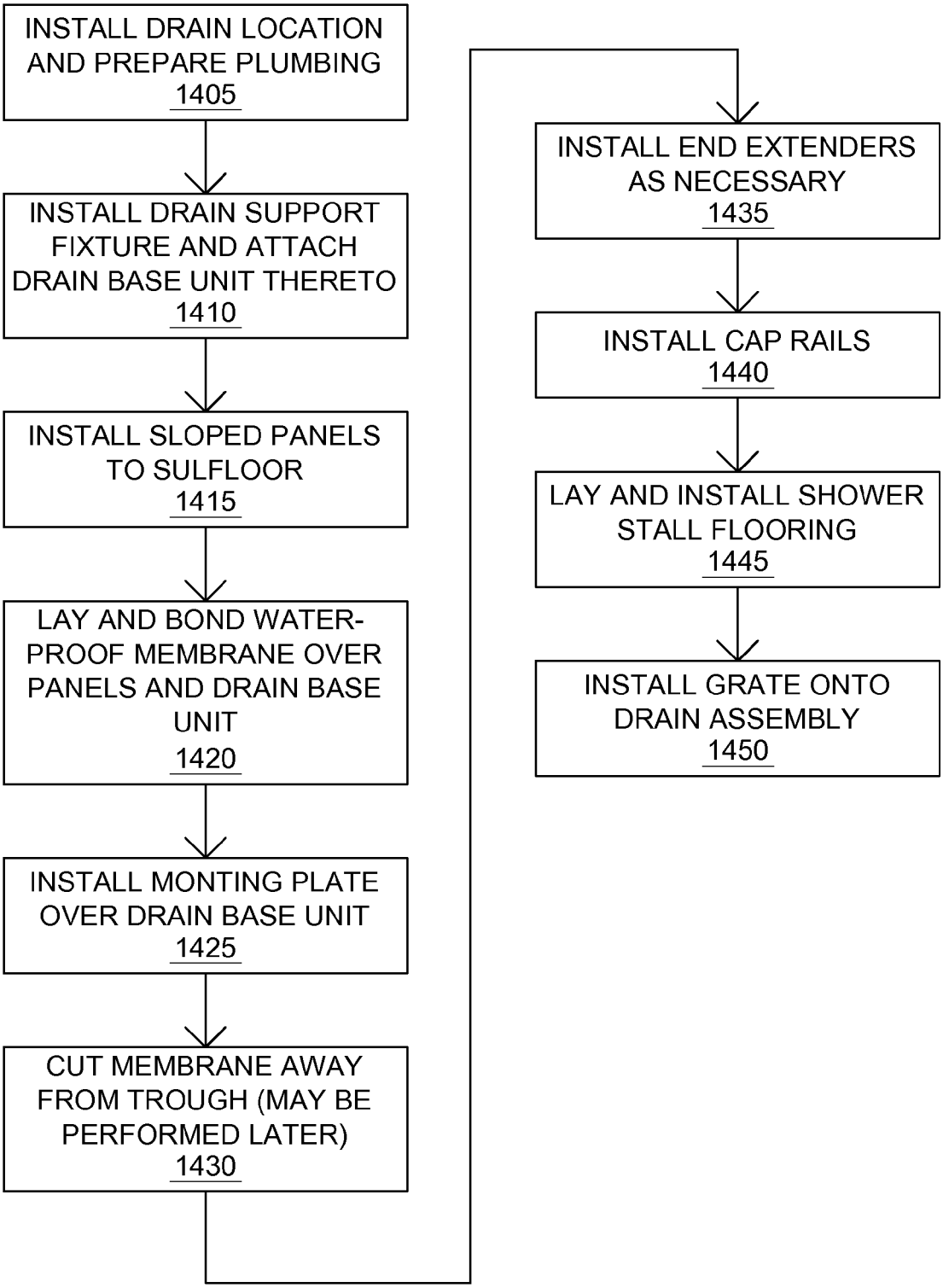
FIG. 14 is a flow chart pertaining to the installation of a shower stall floor using a first method according to one embodiment of the present invention.
Figure 15:
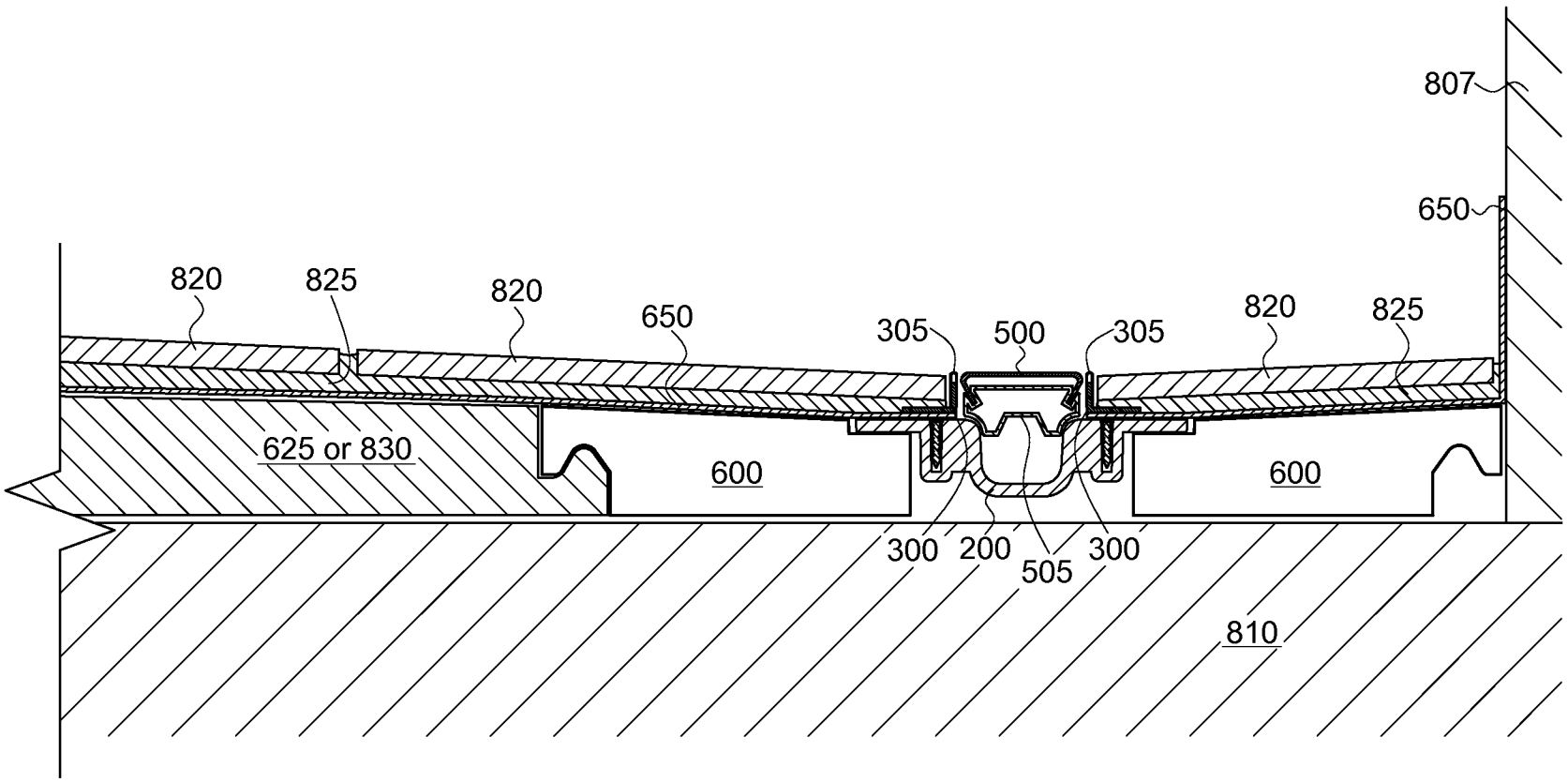
FIG. 15 is a cross section view of an elongated drain assembly taken along line 15-15 of FIG. 1 a installed in a shower floor using the first or a second method of installing a shower stall floor according to one embodiment of the present invention
Figure 18:
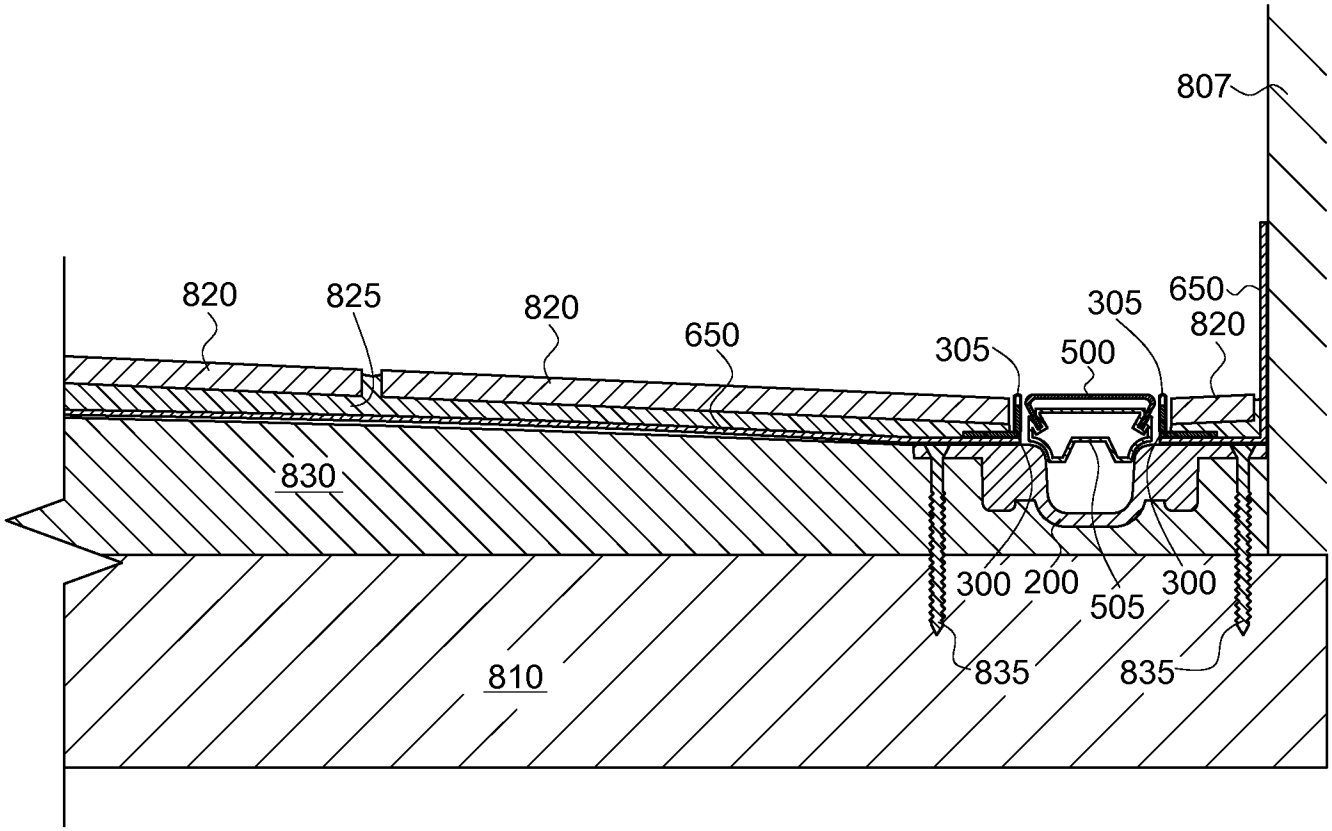
FIG. 18 is a cross section view of an elongated drain assembly taken along line 18-18 of FIG. 1*a* installed in a shower floor using the third method of installing a shower stall floor according to one embodiment of the present invention

Referring to both FIG. 14 and FIG. 15, which comprise a flow chart and cross section of an elongated drain assembly installed in a shower respectively, the process of installing an elongated drain system and associated shower floor according to the first method is described herein. Of note, the slopes and other dimensions and dimensional relationships as shown in the cross sectional FIGS. 15 & 18 are exaggerated as necessary for sake of clarity. Initially as indicated in block 1405, a location for the drain is determined. Typically a location near a shower stall wall 807 is desired wherein the drain assembly with or without end extenders 400 can span substantially the entire width of the pan. A suitable opening is cut in the subfloor 810 as necessary and the drain pipe is plumbed to the opening. Often a no-hub coupling is attached to the end of the pipe for ease of attachment to the drain but alternatively the end can be configured for bonding to the connection on the drain base unit 200.

As indicated in block 1410, a drain support fixture 600 is position around the drain pipe opening and typically secured in place with thinset or a suitable adhesive. The drain base unit is coupled to the drain pipe and set into the support's recess 605 and optionally secured in place with a suitable adhesive.

Next, as indicated in block 1415, the sloped drain panels 625 are installed so that the top surfaces thereof slope generally uniformly towards the drain inlet. Typically, the panels are bonded to the subfloor 810 with a suitable adhesive such as but not limited to thinset. The joints between adjacent panels may also be sealed with adhesive or chalk. Where a suitable drain support fixture is used incorporating the downwardly facing lip 610, the side of a corresponding panel with an upwardly extending lip 630 is mated there with to ensure a more secure and waterproof joint.

Once the shower pan comprising sloped panels 625 has been completed a waterproof membrane 650 is installed over the entire pan and secured at least several inches up the sides of the surrounding walls as indicated in block 1420. The process of installing the membrane is discussed in greater detail in U.S. Pat. No. 8,239,974, which has been incorporated by reference, and as it pertains to the shower pan specifically will not be discussed in greater detail herein. Typically, the membrane is placed over the flange 250 of the drain base unit 200 on which an adhesive bead that encircles the trough has been laid.

Once the membrane 650 is secured to the subfloor and over the drain itself but before the adhesive bead has cured, the drain mounting plate 300 is installed as indicated in block 1425. As mentioned above, the drain base unit 200 comprises a plurality of pointed locating pins 205 or spikes that pierce the membrane 350 and act as locators that correspond to holes 325 in the drain mounting plate. The mounting plate is positioned over the holes and using a plurality of threaded screws, the mounting plate is fastened in place sandwiching the waterproof membrane.

Typically, using a utility knife, the portion of the membrane 650 covering the trough 240 is cut away using the inside edges of the mounting plate 300 as a guide as indicated in block 1430. This particular step maybe performed later in the shower floor and drain installation, such as after the shower floor tile is installed and grouted. This way, the risk of debris falling into the drain is substantially reduced.

After the mounting plate is affixed in place, the end extenders 400 as applicable are installed as indicated in block 1435. Prior to installation as necessary they are cut to the desired length for the particular shower stall as necessary. To secure an end extender, the slot 420 in the bottom leg 415 of the u-shaped portion is slid under the head of an end fastener 805 and around the shaft of thereof, thereby wedging the bottom leg between the fastener head and the top surface of the mounting plate 300. As necessary, the end extender is rotated and slid relative to the fastener to align the extender's orthogonal sidewalls 410 with the sidewalls 310 of the mounting plate. As can be appreciated, the elevated ridges 615 of the drain support provide support for the end extenders and ensures the angle of the extenders properly slope towards the trough 240.

Next as shown in block 1440, the cap rails 305 are trimmed (as necessary) and placed over the orthogonal walls 310 & 410 of both the mounting plate 300 and any applicable end extenders 400. As indicated above, the cap rails are frictionally received and can be adjusted upwardly and downwardly a small amount to accommodate variations in the thickness of tiles that abut the orthogonal walls. The positioning of the cap rail will become effectively fixed in place when the shower floor tiles are secured thereon.

The shower flooring, typically comprising tiles 820, is then laid on the prepared and waterproof membrane 650 covered shower pan typically using a thinset adhesive 825 and known installation techniques as indicated in block 1445. Because in a typical installation the shower drain extends substantially fully across the width of the shower and because the drain is typically positioned against one of the walls/edges in the shower stall, there is minimal fitting of tiles to accommodate compound slopes except perhaps for the tiles directly affixed to the drain support.

Finally, as indicated in block 1450, the drain grate is placed on the drain. As discussed in detail in related U.S. patent application Ser. No. 12/881,164, which has been incorporated by reference, the grate is slid into spacers that have been height adjusted so that the top of the grate is substantially even with the adjacent tiles. The grate/space assembly is then lowered on to the base unit. As can be appreciated, the grate can be removed as necessary, such as to clean the drain trough, by lifting from the drain base unit.

Second Method of Installing the First Embodiment Elongated Drain Assembly

Figure 16:
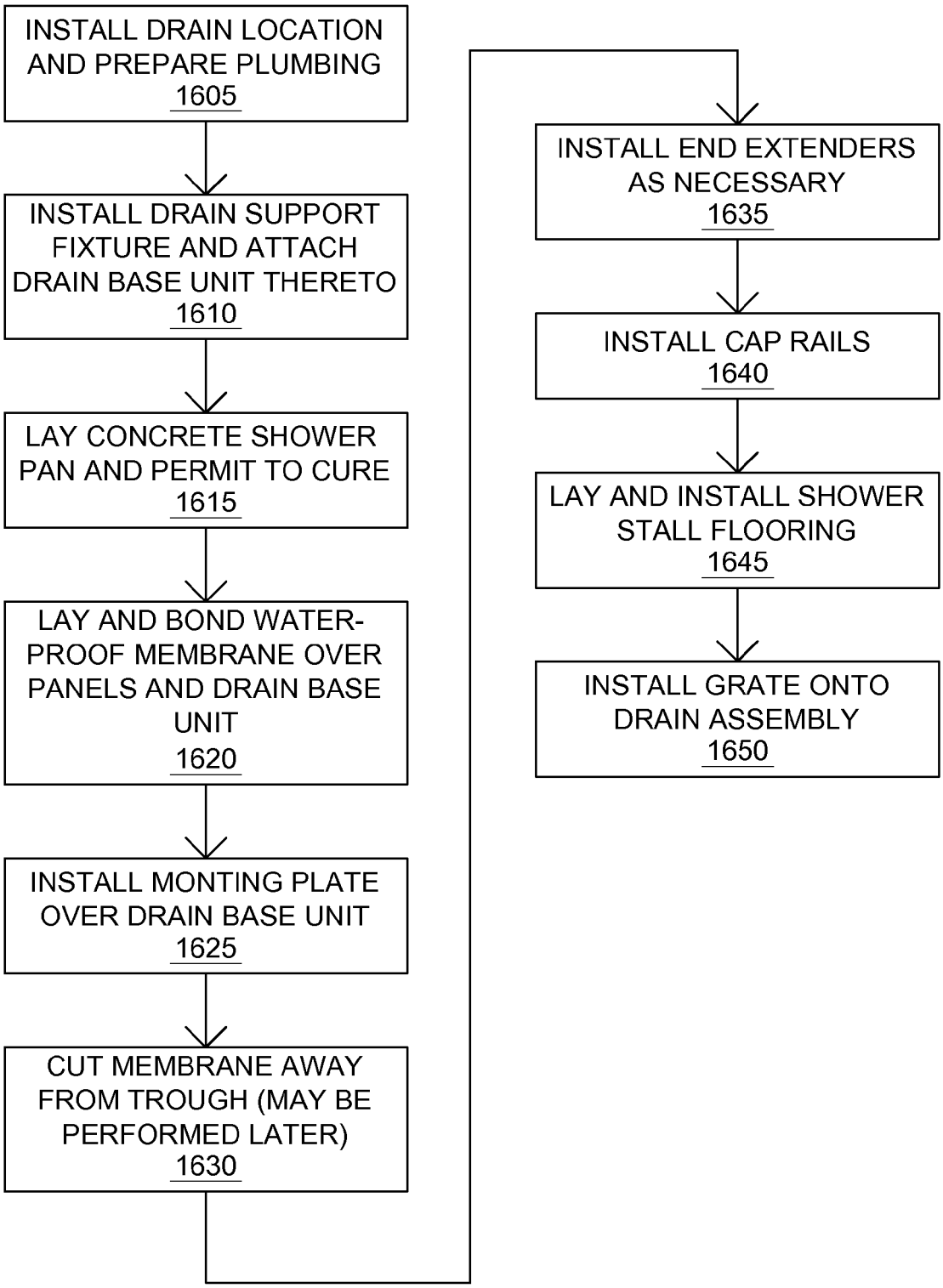
FIG. 16 is a flow chart pertaining to the installation of a shower stall floor using the second method according to one embodiment of the present invention.

Referring to both FIG. 16 and FIG. 15, which comprise a flow chart and cross section of an elongated drain assembly installed in a shower respectively, the process of installing an elongated drain system and associated shower floor according to the second method is described herein. Of note, the cross sectional view of a shower drain installed by the second method is similar in appearance to that of a shower drain installed using the first method except instead of a sloped panel 625 a concrete shower pan 830 is used.

Initially, and similarly to the first method, as indicated in block 1605, a location for the drain is determined. Typically a location near a wall 807 is desired wherein the drain with or without end extenders can span substantially the entire width of the pan. A suitable opening is cut in the subfloor 810 and drain pipe is plumbed thereto. Often a No-hub coupling is attached to the end of the pipe for ease of attachment to the drain but alternatively the end can be configured for bonding to the connection on the drain base unit 200.

As indicated in block 1610, a drain support fixture 600 is position around the drain pipe opening and typically secured in place with thinset or a suitable adhesive. The drain base unit 200 is coupled to the drain pipe and set into the support's recess 605 and optionally secured in place with a suitable adhesive.

Next as shown in block 1615, a concrete shower pan 830 is formed typically using dry set concrete. The process of forming sloped shower pans from concrete is well known in the art and need not be detailed herein. Rather than extend to the edge of the drain base unit 200 the concrete shower pan is formed only up to the edge of the drain support 600.

Once the shower pan 830 has cured and as indicated in block 1620, a waterproof membrane 650 is installed over the entire pan and secured at least several inches up the sides of the surrounding walls 807 underneath the wall covering, which may include water resistant drywall 809 and tile (not shown). The process of installing the membrane is discussed in greater detail in U.S. Pat. No. 8,239,974, which has been incorporated by reference, and as it pertains to the shower pan specifically will not be discussed in greater detail herein.

After the membrane 650 is secured to the subfloor 810 and over the drain itself, the drain mounting plate 300 is installed as indicated in block 1625. As mentioned above, the drain base unit 200 comprises a plurality of pointed locating pins 205 or spikes that pierce the membrane and act as locators that correspond to locating holes 325 in the drain mounting plate. The mounting plate is positioned over the mounting holes 330 and using a plurality of threaded screws the mounting plate is fastened in place sandwiching the waterproof membrane.

Typically, using a utility knife, the portion of the membrane 650 covering the trough 240 is cut away using the inside edges of the mounting plate 300 as a guide as indicated in block 1630. This particular step maybe performed later in the shower floor and drain installation, such as after the shower floor tile is installed and grouted. This way, the risk of debris falling into the drain is substantially reduced.

After the mounting plate is affixed in place, the end extenders 400 as applicable are installed as indicated in block 1635. Prior to installation as necessary they are cut to the desired length for the particular shower stall as necessary. To secure an end extender, the slot 420 in the bottom leg 415 of the u-shaped portion is slid under the head of an end fastener 805 and around the shaft of thereof, thereby wedging the bottom leg between the fastener head and the top surface of the mounting plate 300. As necessary, the end extender is rotated and slid relative to the fastener to align the extender's orthogonal sidewalls 410 with the sidewalls 310 of the mounting plate. As can be appreciated, the elevated ridges 615 of the drain support provide support for the end extenders and ensure the angle of the extenders properly slope towards the trough 240.

Next as shown in block 1640, the cap rails 305 are trimmed (as necessary) and placed over the orthogonal walls 310 & 410 of both the mounting plate 300 and any applicable end extenders 400. As indicated above, the cap rails are frictionally received and can be adjusted upwardly and downwardly a small amount to accommodate variations in the thickness of tiles that abut the orthogonal walls. The positioning of the cap rail will become effectively fixed in place when the shower floor tiles are secured thereon.

The shower flooring, typically comprising tiles 820, is then laid on the prepared and waterproof membrane 650 covered shower pan typically using a thinset adhesive 825 and known installation techniques as indicated in block 1645. Because in a typical installation the shower drain extends substantially fully across the width of the shower and because the drain is typically positioned against one of the walls/edges in the shower stall, there is minimal fitting of tiles to accommodate compound slopes except perhaps for the tiles directly affixed to the drain support.

Finally, as indicated in block 1650, the drain grate is placed on the drain. As discussed in detail in related U.S. patent application Ser. No. 12/881,164, which has been incorporated by reference, the grate is slid into spacers that have been height adjusted so that the top of the grate is substantially even with the adjacent tiles. The grate/space assembly is then lowered on to the base unit. As can be appreciated, the grate can be removed as necessary, such as to clean the drain trough, by lifting from the drain base unit.

Third Method of Installing the First Embodiment Elongated Drain Assembly

Figure 17:
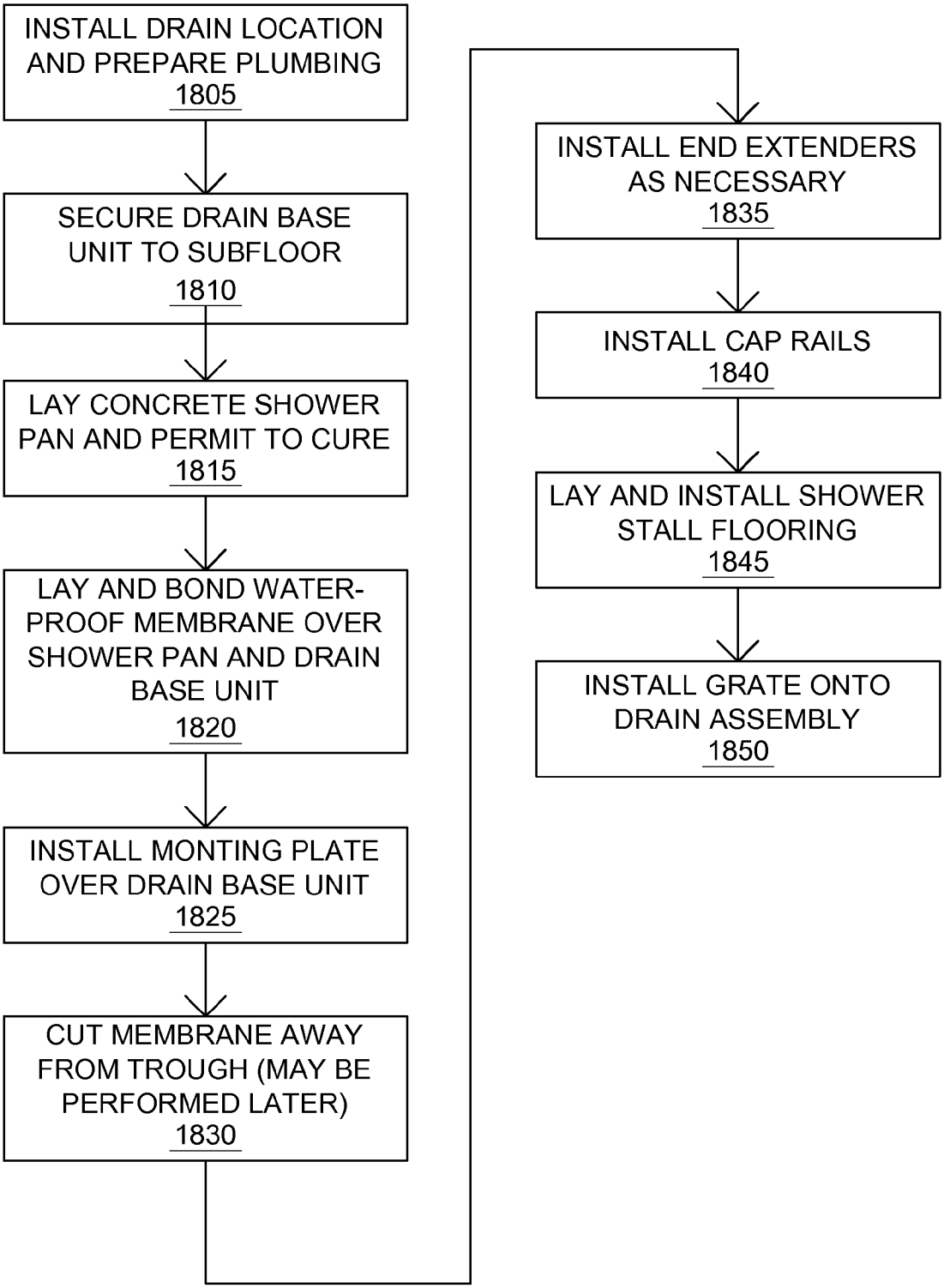
FIG. 17 is a flow chart pertaining to the installation of a shower stall floor using a third method according to one embodiment of the present invention.

Referring to both FIG. 17 and FIG. 18, which comprise a flow chart and cross section of an elongated drain assembly installed in a shower respectively, the process of installing an elongated drain system and associated shower floor according to the third method is described herein. Initially, and similarly to the first and second methods, as indicated in block 1705, a location for the drain is determined. Typically a location near a wall 807 is desired wherein the drain with or without end extenders can span substantially the entire width of the pan. A suitable opening is cut in the subfloor 810 and drain pipe is plumbed thereto. Often a No-hub coupling is attached to the end of the pipe for ease of attachment to the drain but alternatively the end can be configured for bonding to the connection on the drain base unit 200.

Unlike with the previous two methods, the drain base unit 200 is placed directly on the subfloor 807 and secured directly thereto as indicated in block 1710. Adjustment screws (not shown) are threaded into the downwardly facing legs/bosses 237 near the distal ends of the wing sections 215,220. Using the screws the height of the drain unit is set as desired to accommodate the anticipated thickness of the shower pan. The drain is secured to the subfloor with wood screws 835 that are passed through the chamfered holes 270 provided in the flange 250 of the base unit.

Next as shown in block 1715, a concrete shower pan 830 is formed typically using dry set concrete. The process of forming sloped shower pans from concrete is well known in the art and need not be detailed herein. The dry set concrete is extended to the edge of the flange 250 and is often packed underneath the base unit 200 as well to provide support thereto.

Once the shower pan has cured and as indicated in block 1720, a waterproof membrane 650 is installed over the entire pan and secured at least several inches up the sides of the surrounding walls 807. The process of installing the membrane is discussed in greater detail in U.S. Pat. No. 8,239,974, which has been incorporated by reference, and as it pertains to the shower pan specifically will not be discussed in greater detail herein.

After the membrane 650 is secured to the subfloor 810 and over the drain itself, the drain mounting plate 300 is installed as indicated in block 1725. As mentioned above, the drain base unit 200 comprises a plurality of pointed locating pins 205 or spikes that pierce the membrane and act as locators that correspond to locating holes 325 in the drain mounting plate. The mounting plate is positioned over the mounting holes 330 and using a plurality of threaded screws the mounting plate is fastened in place sandwiching the waterproof membrane.

Typically, using a utility knife, the portion of the membrane 650 covering the trough 240 is cut away using the inside edges of the mounting plate 300 as a guide as indicated in block 1730. This particular step maybe performed later in the shower floor and drain installation, such as after the shower floor tile is installed and grouted. This way, the risk of debris falling into the drain is substantially reduced.

After the mounting plate 300 is affixed in place, the end extenders 400 as applicable are installed as indicated in block 1735. Prior to installation as necessary they are cut to the desired length for the particular shower stall as necessary. To secure an end extender, the slot 420 in the bottom leg 415 of the u-shaped portion is slid under the head of an end fastener 805 and around the shaft of thereof, thereby wedging the bottom leg between the fastener head and the top surface of the mounting plate 300. As necessary, the end extender is rotated and slid relative to the fastener to align the extender's orthogonal sidewalls 410 with the sidewalls 310 of the mounting plate.

Next as shown in block 1740, the cap rails 305 are trimmed (as necessary) and placed over the orthogonal walls 310 & 410 of both the mounting plate 300 and any applicable end extenders 400. As indicated above, the cap rails are frictionally received and can be adjusted upwardly and downwardly a small amount to accommodate variations in the thickness of tiles that abut the orthogonal walls. The positioning of the cap rail will become effectively fixed in place when the shower floor tiles are secured thereon.

The shower flooring, typically comprising tiles 820, is then laid on the prepared and waterproof membrane 650 covered shower pan typically using a thinset adhesive 825 and known installation techniques as indicated in block 1745. Because in a typical installation the shower drain extends substantially fully across the width of the shower and because the drain is typically positioned against one of the walls/edges in the shower stall, there is minimal fitting of tiles to accommodate compound slopes except perhaps for the tiles directly affixed to the drain support. To provide support for the end extenders and to help secure them in place to prevent unintended movement thinset can be packed underneath the extenders to provide support when cured.

Finally, as indicated in block 1750, the drain grate is placed on the drain. As discussed in detail in related U.S. patent application Ser. No. 12/881,164, which has been incorporated by reference, the grate is slid into spacers that have been height adjusted so that the top of the grate is substantially even with the adjacent tiles. The grate/space assembly is then lowered on to the base unit. As can be appreciated, the grate can be removed as necessary, such as to clean the drain trough, by lifting from the drain base unit.

A Second Embodiment of an Elongated Drain Assembly

Figure 19:
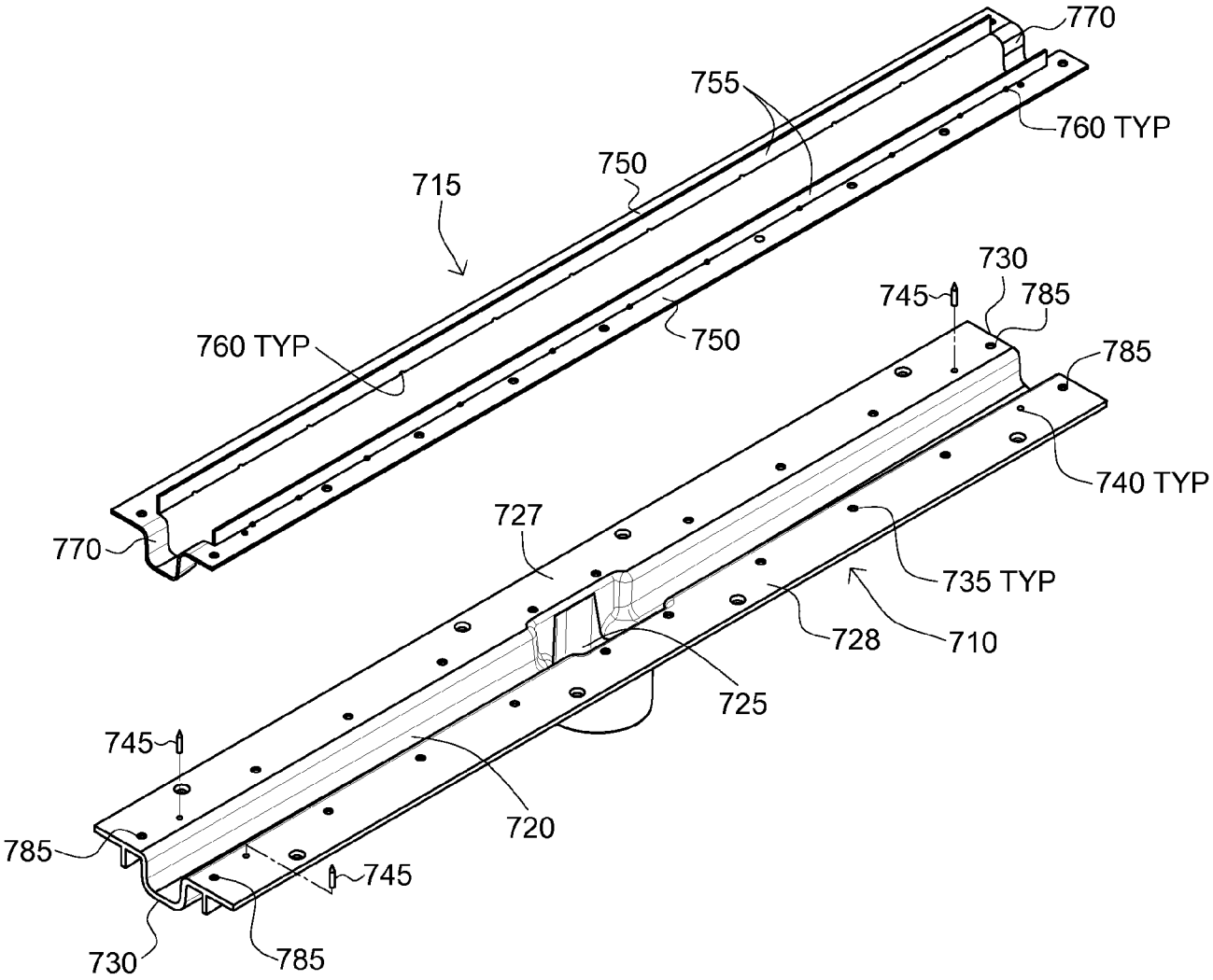
FIG. 19 is an isometric top view of a drain body and associated mounting bracket according to another embodiment of the present invention.
Figure 20:
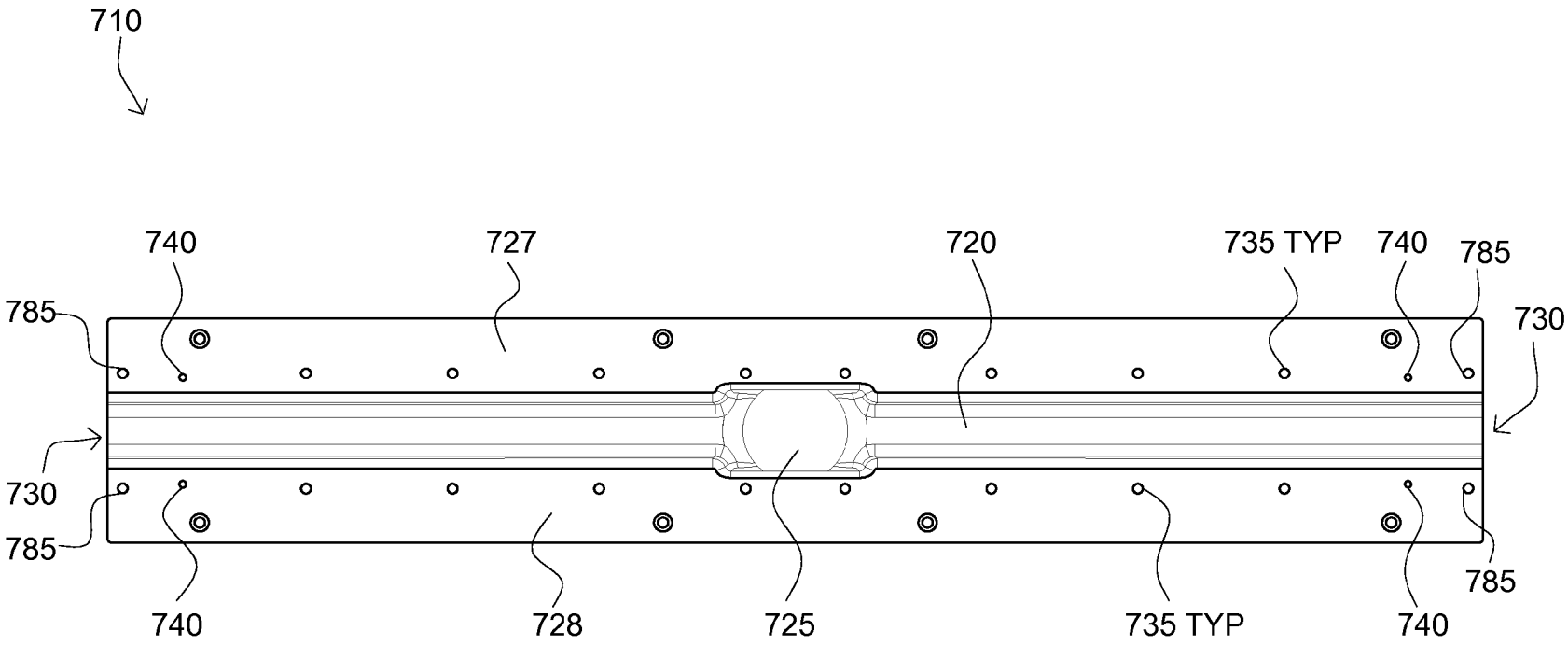
FIG. 20 is a top view of the drain body according to the other embodiment of the present invention.

FIG. 19 is an isometric view of an open ended drain base unit 710 and an associated mounting bracket 715. A top view of the base unit is also shown in FIG. 20. The base unit of this embodiment is typically comprised of the same materials and manufactured using the same methods as the base unit 200 described in the first embodiment. The trough 720 is similarly sloped and the drain outlet 725 is similar in configuration and provided in both vertical and horizontal discharge variations. Generally, the base unit 710 is substantially similar to the center section 210 of the first embodiment base unit 210 except for (i) the placement of the various fastener holes and other features on the left and right flanges 727 & 728 surrounding the trough, and (ii) flat ends 730 as this base unit is not intended to mate in an interlocking fashion with left or right wing sections 215. Similar to the base unit of the first embodiment, the flange includes numerous spaced bosses 735 & 785, as well as, pin holes 740 to receive locating pins 745.

Figure 21:
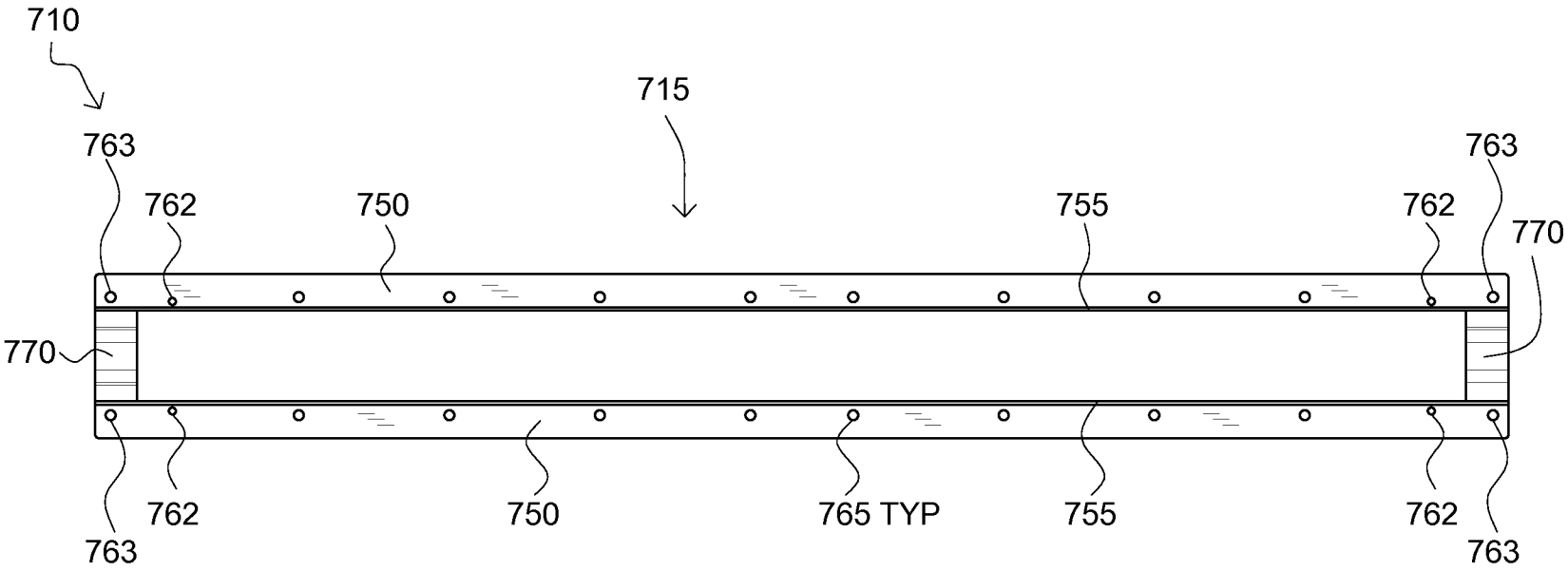
FIG. 21 is a top view of the mounting bracket according to the other embodiment of the present invention.

The mounting bracket 715, which is shown in both FIGS. 19 and 21, is also generally similar to the mounting bracket 300 of the first embodiment including flange sections 750, orthogonal walls 755, weep holes 760 (not shown in FIG. 21), locating pin holes 762 and mounting holes 765. Unlike the bracket of the previous embodiment, however, there are no end flange portions. Rather, the two elongated sides of the bracket are joined together by left and right generally u-shaped end members 770 that follow the contours of the trough they directly overlay.

Figure 22:
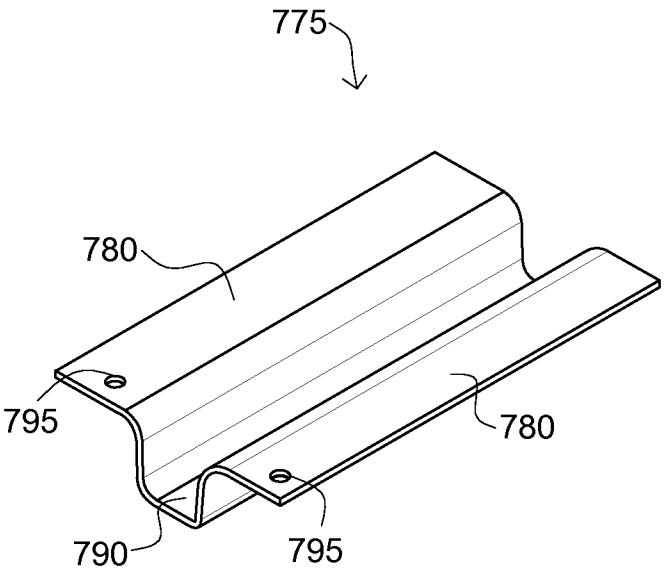
FIG. 22 is an isometric top view of an end extender according to the other embodiment of the present invention.

The base unit 710 and the mounting bracket are often combined with left and right end extenders 775 as shown in FIG. 22. The end extenders are typically comprised of thin walled stainless steel (typically 22-26*g*) but variations can be comprised of other materials. As can be appreciated the length of the extenders can vary to permit fitment of a drain assembly in shower stalls of different widths.

Figure 23:
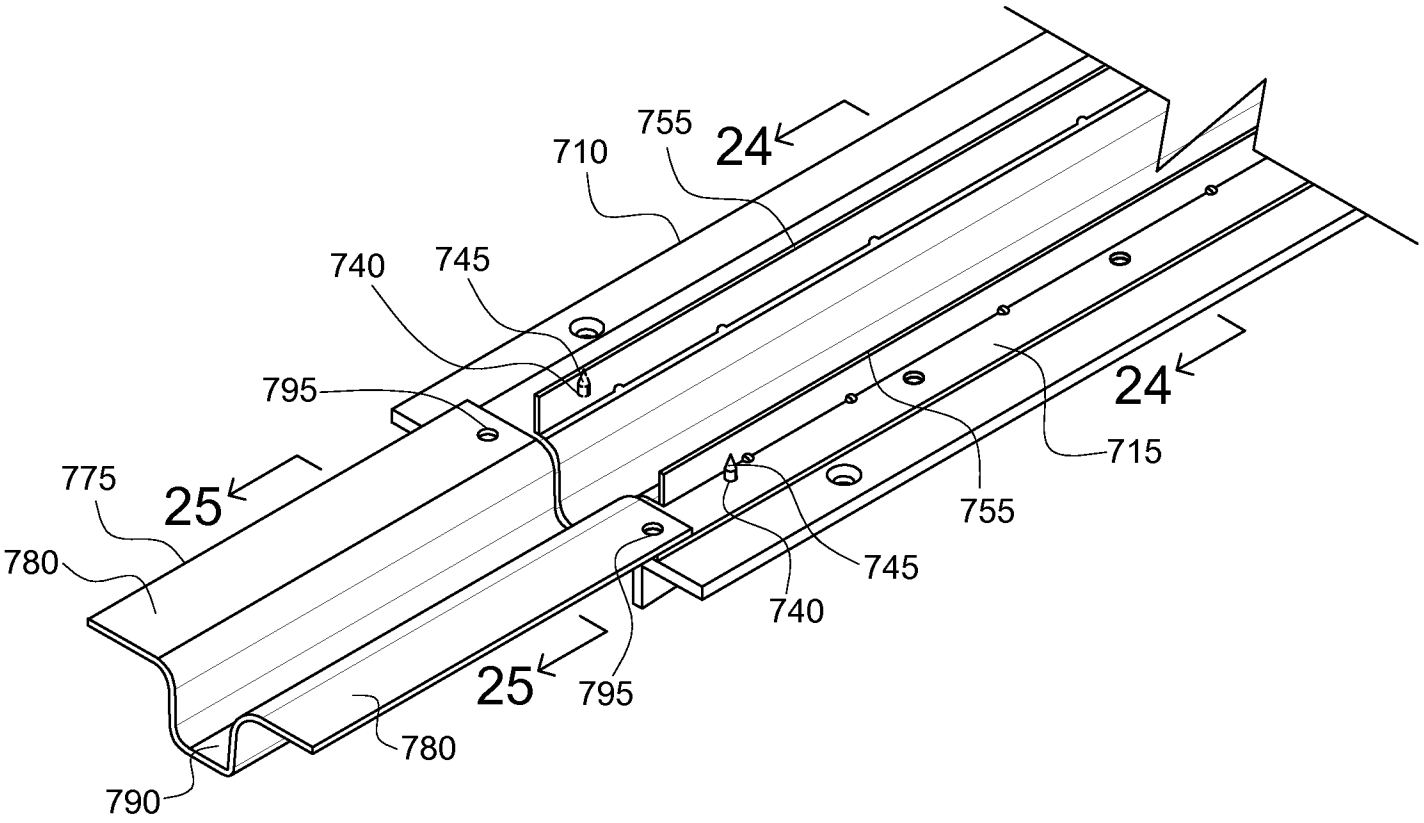
FIG. 23 is an isometric view illustrating one end of the drain with the extender installed over a membrane according to the other embodiment of the present invention.

Referring to FIGS. 22 & 23, the end extenders 775 mount to the open ends of the base unit 710 over the mounting bracket 715 and each is secured to a respective end by a pair of fasteners that pass through fastener holes 795 in the extender, fastener holes 763 in the mounting bracket and into the corresponding bosses 785 on the base unit. The extender includes a trough 790. Typically, the end extender trough is either sloped or installed at an angle relative to the base unit trough so that water received in it is channeled into the base unit trough 720. The end extender trough at the mounting end of the extender overlaps both the end of the trough 720 of the base unit and the u-shaped members 770. Of important note the end extenders are typically installed over the waterproof membrane as is discussed in detail below; however, for sake of clarity and demonstration the waterproof membrane is omitted from FIG. 23.

In at least some variations the ends of the extenders 775 are open in a similar fashion as the ends of the base unit 710. In use, as is discussed in detail below, the waterproof membrane is folded up over the ends of one of the ends of the base unit or the ends of the extenders ensuring the flow of water into the base unit trough and eventually an associated shower drain pipe. Considering the end of the extenders are open, it follows that longer extenders can be cut down in length as necessary during use to ensure proper fitment in a shower stall application. For instance, if a 24" is base unit is provided with two 14" end extenders 775, the end extenders can be cut down to about 8" each to span a 40" stall.

Also of significant note, there are no orthogonal walls on the end extenders 775. Rather during installation the edge of the shower floor tile is terminated close to the edge of the extender trough 790. When a more finished edge is desired or required, tile edging (not shown), typically comprised of aluminum can be used. In some variations, the orthogonal side wall of the mounting bracket can be eliminated as well relying on tile edging for the entire length of the drain assembly.

A Method of Installing the Second Embodiment Elongated Drain Assembly

Figure 24:
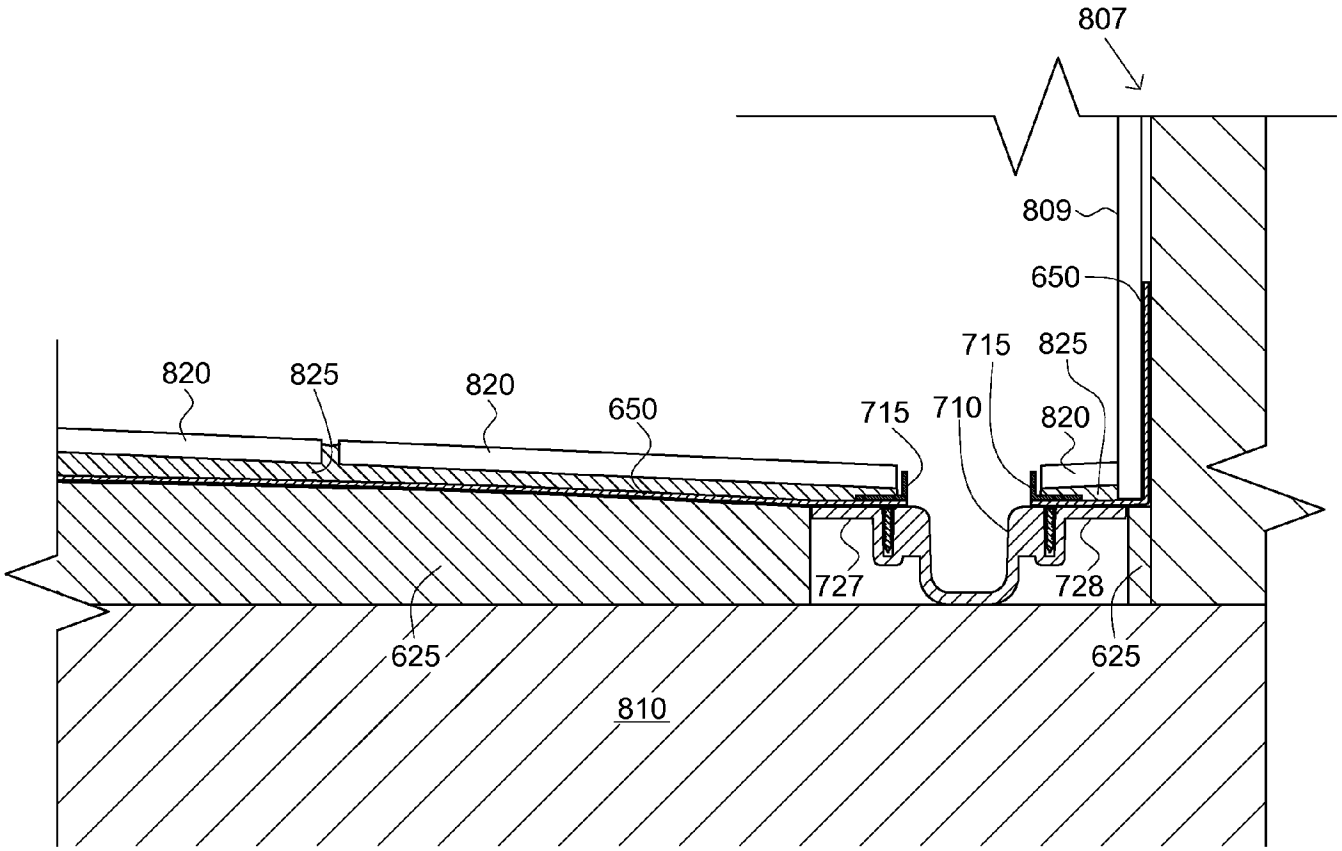
FIG. 24 is a cross sectional view taken along lines 24-24 of FIG. 23 according to the other embodiment of the present invention.
Figure 25:
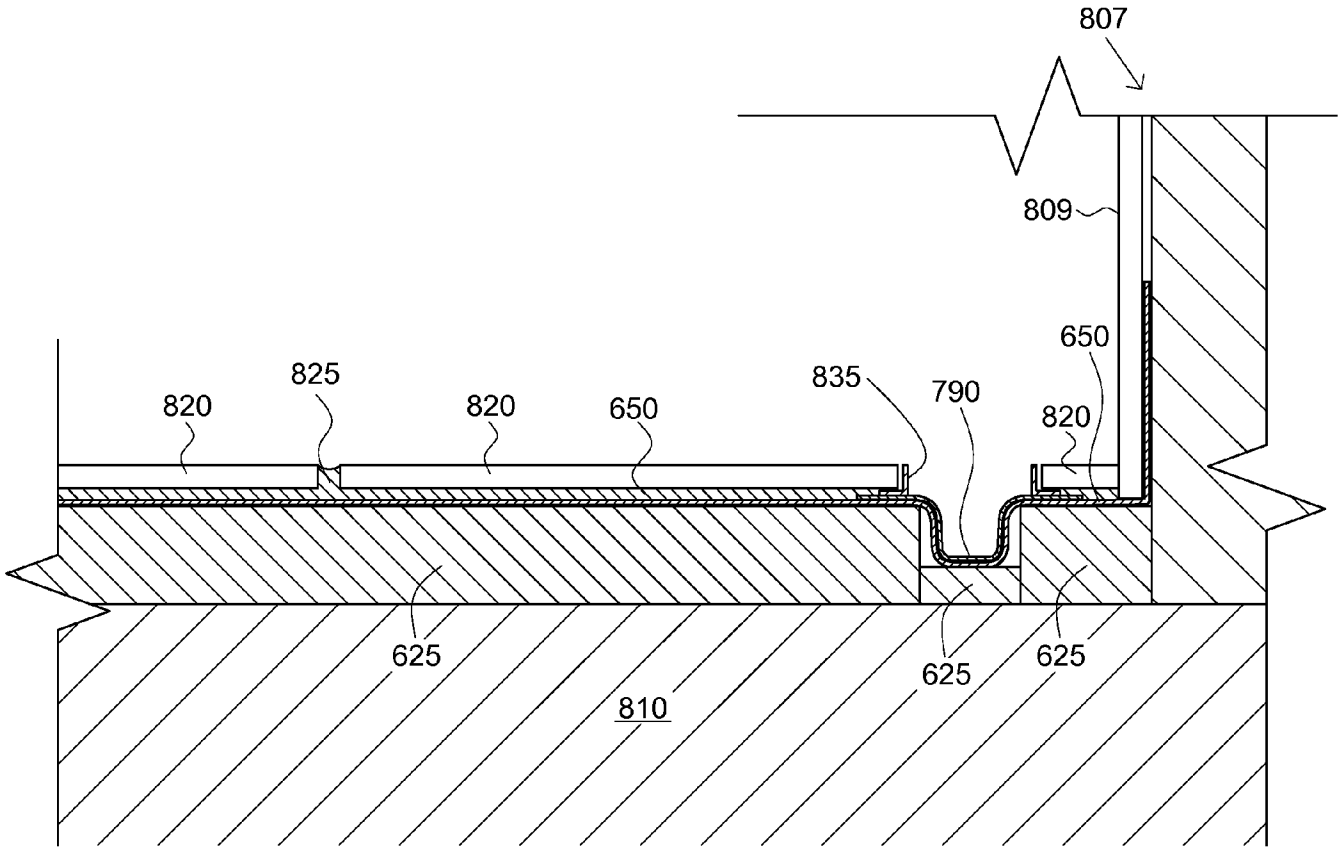
FIG. 25 is a cross sectional view taken along lines 25-25 of FIG. 23 according to the other embodiment of the present invention.
Figure 26:
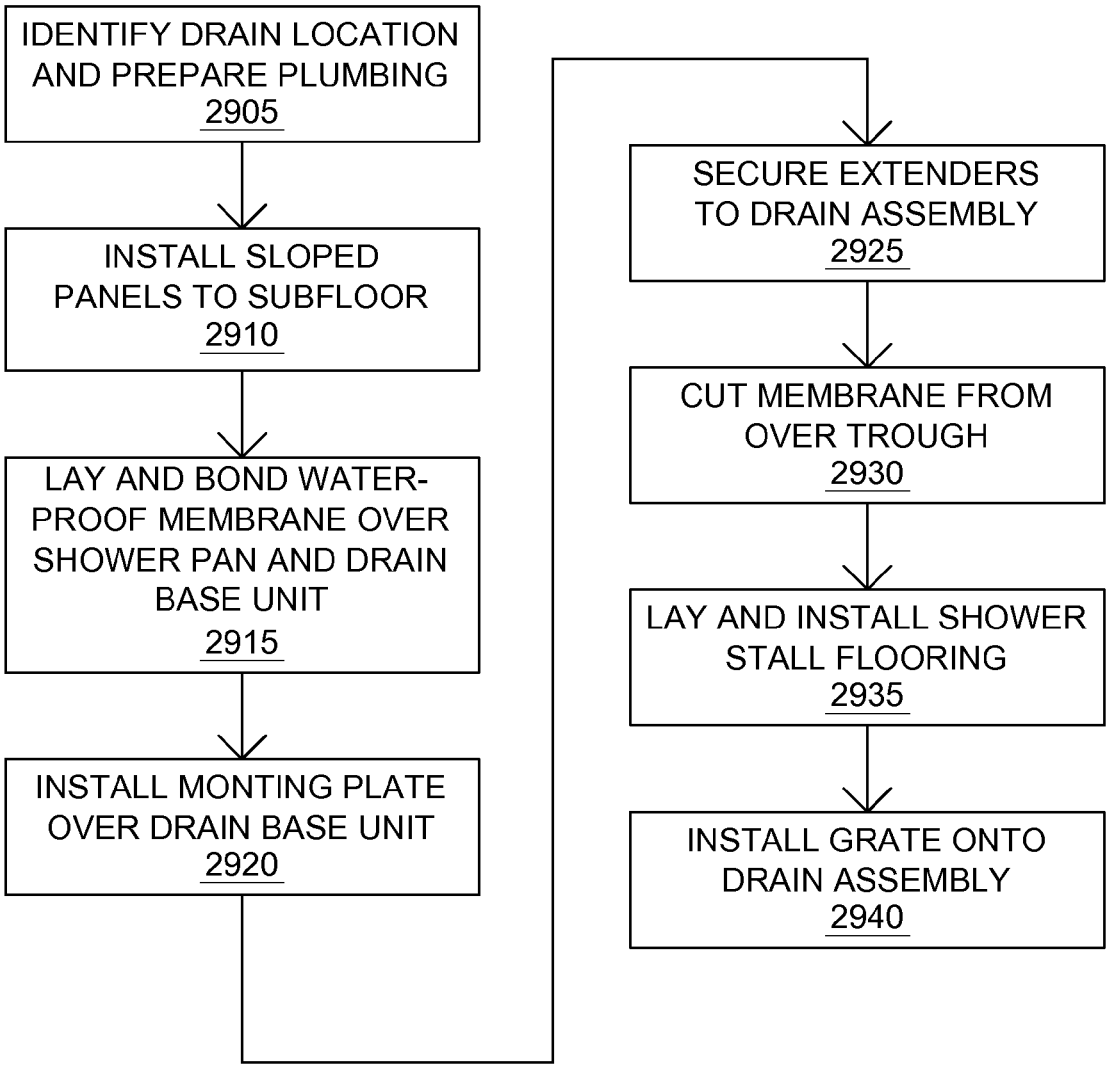
FIG. 26 is a flow chart pertaining to a fourth method of installing a shower stall floor using the other embodiment elongated drain system.

FIGS. 24 and 25 are cross sections of a fully installed drain assembly taken along lines indicated in FIG. 23. With reference to the flow chart of FIG. 26 and the foregoing listed figures, a method of installing the second embodiment floor drain is described, as well as, the specific configuration of the installed elongated drain assembly. While only a single installed configuration is specifically described herein, one of ordinary skill will appreciate that the second embodiment can be installed in similar configurations as the several methods described concerning the first embodiment with obvious changes being made to the installation as is necessitated by the differences in the designs of the two drain assembly embodiments.

Initially as indicated in block 2905, a location for the drain is determined. Typically, a location near a shower stall wall 807 is desired wherein the drain assembly in this case with end extenders 775 can span substantially the entire width of the pan. A suitable opening is cut in the subfloor 810 as necessary and the drain pipe is plumbed to the drain discharge opening 725. Often a no-hub coupling is attached to the end of the pipe for ease of attachment to the drain but alternatively the end can be configured for bonding to the drain base unit 710.

Next, as indicated in block 2910, the sloped drain panels 625 are installed so that the top surfaces thereof slope generally uniformly towards the drain inlet aligning vertically with the outer edges of the base unit flanges 727 & 728. The panels are arranged to surround all four sides of the base unit except where the base unit is butted against a shower stall wall in which case the panels are arranged around three sides of the base unit. Where extensions 790 are used, the thickness of the sloped panel underneath the extension may be reduced to accommodate the bottom of the extension as shown in FIG. 25. In other variations the sloped panels will terminate at the edge of the extensions flange and other means, such as but not limited to dry pack can be used to support the bottom of the extension. Typically, the panels are bonded to the subfloor 810 with a suitable adhesive such as, but not limited to, thinset. In alternative installation methods, dry pack can be used to create a shower stall subfloor in place of the panels wherein the dry pack surface slopes towards the drain inlet as well.

Once the shower pan comprising the sloped panels 625 has been completed a waterproof membrane 650 is installed over the entire pan and secured at least several inches up the sides of the surrounding walls underneath the wall covering, which may include water resistant drywall 809 and tile (not shown), as indicated in block 2915. The process of installing the membrane is discussed in greater detail in U.S. Pat. No. 8,239,974, which has been incorporated by reference, and as it pertains to the shower pan specifically will not be discussed in greater detail herein. Typically, the membrane is placed over the flanges 727 & 728 of the drain base unit 710 on which an adhesive bead that parallels the length of the trough has been laid.

Once the membrane 650 is secured to the subfloor and over the drain itself but before the adhesive bead has cured, the drain mounting bracket 715 is installed as indicated in block 2920. As mentioned above, the drain base unit 710 comprises a plurality of pointed locating pins 745 or spikes that pierce the membrane 650 and act as locators that correspond to holes 740 in the drain mounting bracket 715. The mounting bracket is positioned over the holes and using a plurality of threaded screws, the mounting bracket is fastened in place sandwiching the waterproof membrane between the base unit and the flanges and u-shaped members of the mounting bracket.

In a typical installation as indicated in block 2925, end extenders 775 are secured to the ends of the drain base unit 710 overlapping the ends and substantially covering the u-shaped members 770 of the mounting bracket 715. The flanges 780 of the end extenders overlap the left and right flanges 727 & 728 of the bracket. When the bracket is fastened using the plurality of screws, the associated screws are passed through the extender's flanges, through the bracket flange and into underlying bosses 785. Of specific note, the extenders are installed over and on top of the waterproof membrane, which is adhesively secured to the sloped panel below it.

Typically, using a utility knife, the portion of the membrane 650 covering the trough 720 is cut away using the inside edges of the mounting bracket 715 including the inside edges of the u-shaped end members 770 as a guide as indicated in block 2930. This particular step maybe performed later in the shower floor and drain installation, such as after the shower floor tile is installed and grouted. This way, the risk of debris falling into the drain is substantially reduced.

The shower flooring, typically comprising tiles 820, is then laid on the prepared and waterproof membrane 650 covered shower pan typically using a thinset adhesive 825 and known installation techniques as indicated in block 2935. Because in a typical installation the shower drain extends substantially fully across the width of the shower and because the drain is typically positioned against one of the walls/edges in the shower stall, there is minimal fitting of tiles to accommodate compound slopes except perhaps for the tiles directly affixed to the drain support. As shown in FIG. 25 aluminum edging 835 may be installed along the edge of the tile bordering the drain.

Finally, as indicated in block 2940, the drain grate is placed on the drain. As discussed in detail in related U.S. patent application Ser. No. 12/881,164, which has been incorporated by reference, the grate is slid into spacers that have been height adjusted so that the top of the grate is substantially even with the adjacent tiles. The grate/space assembly is then lowered on to the base unit. As can be appreciated, the grate can be removed as necessary, such as to clean the drain trough, by lifting from the drain base unit.

Variations and Other Embodiments

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A elongated drain assembly, the assembly comprising:

a base unit, the base unit including (i) an elongated trough with a discharge opening located at a bottom therein, the trough having an elongated left, and elongated right side, and opposing lateral ends spanning between the elongated sides, (ii) a horizontal right flange extending outwardly from a top edge of the right side, (iii) a horizontal left flange extending outwardly from a top edge of the left side, a plurality of bores extending vertically downwardly from top surfaces of the respective left and right flanges and (iv) a plurality of pointed locator pins extending upwardly from the left and right flanges; and a mounting bracket, having a mounting plate including (a) left and right horizontal bracket flanges, the left and right bracket flanges being configured to overlie the left and right flanges and being spaced apart at least a lateral width of the trough, (b) a plurality of fastener holes in the left and right bracket flanges, the fastener holes configured to simultaneously align with the plurality of bores, (c) a plurality of locator pin holes that are configured to align with and receive the plurality of locator pins therethrough.

2. The elongated drain assembly of claim 1, wherein the locator pins are selectively removable from the remainder of the base unit.

3. The elongated drain assembly of claim 1, wherein the base unit is substantially comprised of a polymeric material.

4. The elongated drain assembly of claim 3, wherein the mounting bracket is comprised of a stainless steel.

5. The elongated drain assembly of claim 1, wherein the mounting bracket further includes a left orthogonal wall extending upwardly from an inside edge of the left bracket flange, and a right orthogonal wall extending upwardly from an inside edge of the right bracket flange.

6. The elongated drain assembly of claim 1, further including two end extenders, each end extender configured for selective attachment to a lateral end of the base unit and including an extender trough, each extender trough being in fluid communication with the trough.

7. The elongated assembly of claim 6, wherein the end extenders comprise stainless steel.

8. The elongated assembly of claim 6, wherein each end extender includes proximal and distal lateral ends, the proximal end of each being coupled to a lateral end of the base unit, and the distal end of each being open without a lateral wall enclosing the associated extender trough.

9. The elongated drain assembly of claim 1, further including a drain cover and spacers for coupling the drain cover to the base unit.

10. The elongated drain assembly of claim 1, further including a waterproof membrane, the waterproof membrane being sandwiched between the base unit and the mounting bracket.

11. The elongated drain assembly of claim 1, wherein the mounting bracket further includes a pair of u-shaped portions, the first u-shaped portion extending between the left and right bracket flanges at a first lateral end, and a second u-shaped portion extending between left and right bracket flanges at a second lateral end, the second lateral end being opposite the first lateral end, each u-shaped portion having an outside surface being shaped substantially similar to the interior surface of the trough it overlies.

12. The elongated assembly of claim 9, further including a waterproof membrane, the waterproof membrane being sandwiched between the base unit and mounting flange.

13. A method of installing the elongated drain assembly of claim 1 in a shower stall, the method comprising, determining a location to install the drain assembly and preparing associated plumbing;

affixing drain base unit to the plumbing at the discharge opening;

fabricating shower pan substantially surrounding the drain base unit;

laying and bonding waterproof membrane to shower pan and base unit right and left flanges;

pressing locator pins through membrane;

aligning locator pins with corresponding locator pin holes, and placing pins through locator pin holes; and securing the mounting bracket to the base unit sandwiching the membrane therebetween.

14. The method of claim 13, wherein mounting bracket is secured to the base unit using fasteners passing through the plurality of fastener holes and into the plurality of bores.

15. The method of claim 13, further comprising cutting away waterproof membrane to revel the trough.

16. The method of claim 13, wherein the elongated drain assembly further includes two end extenders, each end extender configured for selective attachment to a lateral end of the base unit and including an extender trough, the method further comprising:

attaching the end extenders to the lateral ends of the base unit on top of the mounting bracket and the waterproof membrane wherein the extender trough is in fluid communication with the trough.

17. The method of claim 13, further comprising installing a tile floor in the shower stall over the waterproof membrane and around the elongated drain assembly.

18. A elongated drain assembly, the assembly comprising:

a base unit, the base unit including (i) an elongated trough with a discharge opening located at a bottom therein, the trough having an elongated left, and elongated right side, and opposing lateral ends spanning between the elongated sides, (ii) a horizontal right flange extending outwardly from a top edge of the right side, (iii) a horizontal left flange extending outwardly from a top edge of the left side, a plurality of bores extending vertically downwardly from top surfaces of the respective left and right flanges and (iv) a plurality of pointed locator pins extending upwardly from the left and right flanges;

a mounting bracket, having a mounting plate including (a) left and right horizontal bracket flanges, the left and right bracket flanges being configured to overlie the left and right flanges and being spaced apart at least a lateral width of the trough, (b) a plurality of fastener holes in the left and right bracket flanges, the fastener holes configured to simultaneously align with the plurality of bores, (c) a plurality of locator pin holes that are configured to align with and receive the plurality of locator pins therethrough, (d) a left orthogonal wall extending upwardly from an inside edge of the left bracket flange, and (e) a right orthogonal wall extending upwardly from an inside edge of the right bracket flange;

two end extenders, each end extender configured for selective attachment to a lateral end of the base unit and including an extender trough, each extender trough being in fluid communication with the trough; and a drain cover and spacers for coupling the drain cover to the base unit.

19. The elongated base unit of claim 18, further including a waterproof membrane, the waterproof membrane being sandwiched between the base unit and mounting flange.

20. The elongated base unit of claim 18, wherein each end extender includes proximal and distal lateral ends, the proximal end of each being coupled to a lateral end of the base unit, and the distal end of each being open without a lateral wall enclosing the associated extender trough.

* * * * *